US007742709B2

(12) United States Patent
Katogi et al.

(10) Patent No.: US 7,742,709 B2
(45) Date of Patent: Jun. 22, 2010

(54) DEVELOPER CARTRIDGE HAVING DIFFERENT COMMUNICATION STATES WITH AN IMAGE FORMING APPARATUS

(75) Inventors: Syuichi Katogi, Toyokawa (JP); Hiroshi Mizuno, Aisai (JP); Hiromasa Ueno, Toyohashi (JP); Yasuhiro Suzuki, Anjo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 336 days.

(21) Appl. No.: 11/854,127

(22) Filed: Sep. 12, 2007

(65) Prior Publication Data

US 2008/0095554 A1 Apr. 24, 2008

(30) Foreign Application Priority Data

Oct. 20, 2006 (JP) ..... 2006-286456

(51) Int. Cl.
*G03G 15/08* (2006.01)

(52) U.S. Cl. ..... 399/27

(58) Field of Classification Search ..... 399/12, 399/27, 61, 111

See application file for complete search history.

(56) References Cited

U.S. PATENT DOCUMENTS 5,963,759 A 10/1999 Kojima et al.
2006/0029406 A1* 2/2006 Nagahama et al. ..... 399/27

FOREIGN PATENT DOCUMENTS

JP 2-7672 1/1990
JP 10-49032 2/1998
JP 2002-169428 6/2002
JP 2005-195790 7/2005
JP 2005-195791 7/2005
JP 2005-234499 9/2005
JP 2005-300685 10/2005
JP 2006-53181 2/2006

OTHER PUBLICATIONS

Japanese Office Action mailed on Oct. 28, 2008 directed towards counterpart foreign application No. 2006-286456; 8 pages.

Japanese Notification of Reason(s) for Refusal, mailed Mar. 17, 2009, directed to counterpart Japanese Patent Application No. 2006-286456; 6 pages.

* cited by examiner

*Primary Examiner*—Hoang Ngo
(74) *Attorney, Agent, or Firm*—Morrison & Foerster LLP

(57) ABSTRACT

An image forming apparatus comprises a cartridge equipped with a toner reservoir, and an apparatus body. The cartridge is attached to the apparatus body when used and developer in the toner reservoir is used for image development. The cartridge comprises a storage unit which is provided inside the toner reservoir and capable of communicating with the apparatus body. The apparatus body comprises a communication unit which is capable of communicating with the storage unit and communication state between the storage unit and the communication unit varies depending on amount of residual developer in the toner reservoir. Thus there is provided a developer cartridge and an image forming apparatus surely capable of carrying out both residual-toner-amount detection and transmission of cartridge information with space saving design.

18 Claims, 31 Drawing Sheets

DEVELOPER CARTRIDGE HAVING DIFFERENT COMMUNICATION STATES WITH AN IMAGE FORMING APPARATUS

CROSS-REFERENCE TO RELATED APPLICATIONS

This application is based upon and claims the benefit of priority from the prior Japanese Patent Applications No. 2006-286456 filed on Oct. 20, 2006, the entire contents of which are incorporated herein by reference.

BACKGROUND OF THE INVENTION

1. Field of the Invention

The present invention relates to a developer cartridge for housing toner and an image forming apparatus wherein the developer cartridge is attached to and detached from the image forming apparatus. More particularly, it relates to a developer cartridge and an image forming apparatus capable of communicating with each other.

2. Description of the Related Art

There has been known an image forming apparatus with a cartridge which is attached to and detached from the apparatus body and houses toner in its container. As typical examples of such cartridge, an imaging cartridge, a toner cartridge, and the like have been known. It is required for the image forming apparatus of this type to detect amount of residual toner in its cartridge at any time. Therefore, there have conventionally been applied a detection method by using a light emitter, a light receiving sensor, and a light guide as a set, or a detection method by using a reflecting sensor and a residual-toner-amount detecting window, or the like. Furthermore, JP Unexamined Patent Publication No. 2005-195791 discloses an image forming apparatus and a residual-toner-amount detecting method wherein contact state of a flexible film strip and a toner detecting electrode is detected to find out residual toner amount.

Some image forming apparatuses of the above-mentioned type have been designed on assumption that attachment and detachment of its cartridge is carried out by a user. It is required for such image forming apparatuses to prevent a cartridge mix-up and an erroneous insertion. For that purpose, some image forming apparatuses employ communication means between an apparatus body and a cartridge. Thereby, the apparatus body can receive information of the cartridge at the time of attachment and notify a user of an error in case of an erroneous attachment. For example, JP Unexamined Patent Publication No. 2002-169428 discloses a cartridge which is equipped with recording means such as IC chip or the like which enables the image forming apparatus to read information of the cartridge. According to the publication, the employment of recording means contributes to space saving design and design diversification.

However, in the above-mentioned conventional image forming apparatuses, residual-toner-amount detecting means and communication means as countermeasure for erroneous insertion are constituted separately. Both of them must be arranged inside or near inside of a cartridge. Furthermore, since it is required for them to secure a detection point, a communication path, and the like, positioning of them is restricted to some extent.

For example, in case an optical sensor is used as residual-toner-amount detecting means, any other composing members cannot be arranged on the detection line of the sensor. To secure detection accuracy of residual toner amount, it is required to secure positional accuracy of a holding member for holding the sensor or the like. It is desired that the communication means be arranged inside of a cartridge so as to prevent damage at the time of attachment. Furthermore, it is also required to arrange the residual-toner-amount detecting means and the communication means without intervention of each other.

SUMMARY OF THE INVENTION

The present invention has been attempted to solve the above-noted problems involved in the conventional cartridges and image forming apparatuses. Thus, an object of the invention is to provide a developer cartridge and an image forming apparatus surely capable of carrying out both residual-toner-amount detection and transmission of cartridge information with space saving design.

To achieve the above object, according to a first aspect of the present invention, there is provided a developer cartridge comprising a developer container, the developer cartridge being attached to an image forming apparatus for use and supplying developer in the developer container to an image forming apparatus for development, wherein the developer cartridge further comprises a communication unit which is provided inside the developer container and capable of communicating with an image forming apparatus, and communication state between the communication unit and the image forming apparatus varies depending on amount of developer in the developer container.

According to the developer cartridge of the first aspect, it can communicate with the image forming apparatus because it has a communication unit. Accordingly, the communication state of the communication unit is easily detected by the image forming apparatus. The communication state of the communication unit varies depending on the amount of developer in the developer container. Accordingly, the image forming apparatus can detect change of the amount of the developer without a detection device which directly detects the amount of developer in the developer container. In this way, there is realized a developer cartridge surely capable of carrying out both residual-toner-amount detection and transmission of cartridge information with space saving design.

According to the second aspect of the present invention, there is also provided an image forming apparatus comprising a developer cartridge equipped with a developer container, and an apparatus body, the image forming apparatus being used with the developer cartridge attached there to supply developer in the developer container for development, wherein the developer cartridge comprises a cartridge-side communication unit which is provided inside the developer container and capable of communicating with the apparatus body, the apparatus body comprises an apparatus-side communication unit which is capable of communicate with the cartridge-side communication unit, and communication state between the cartridge-side communication unit and the apparatus-side communication unit varies depending on amount of developer in the developer container.

The present invention thus realizes a developer cartridge and an image forming apparatus surely capable of carrying out both residual-toner-amount detection and transmission of cartridge information with space saving design.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENT

First Embodiment

A first embodiment will be described in detail with reference to the accompanying drawings. The first embodiment applies the present invention to an image forming apparatus with a developer cartridge which is attachable to and detachable from the apparatus.

Figure 1:
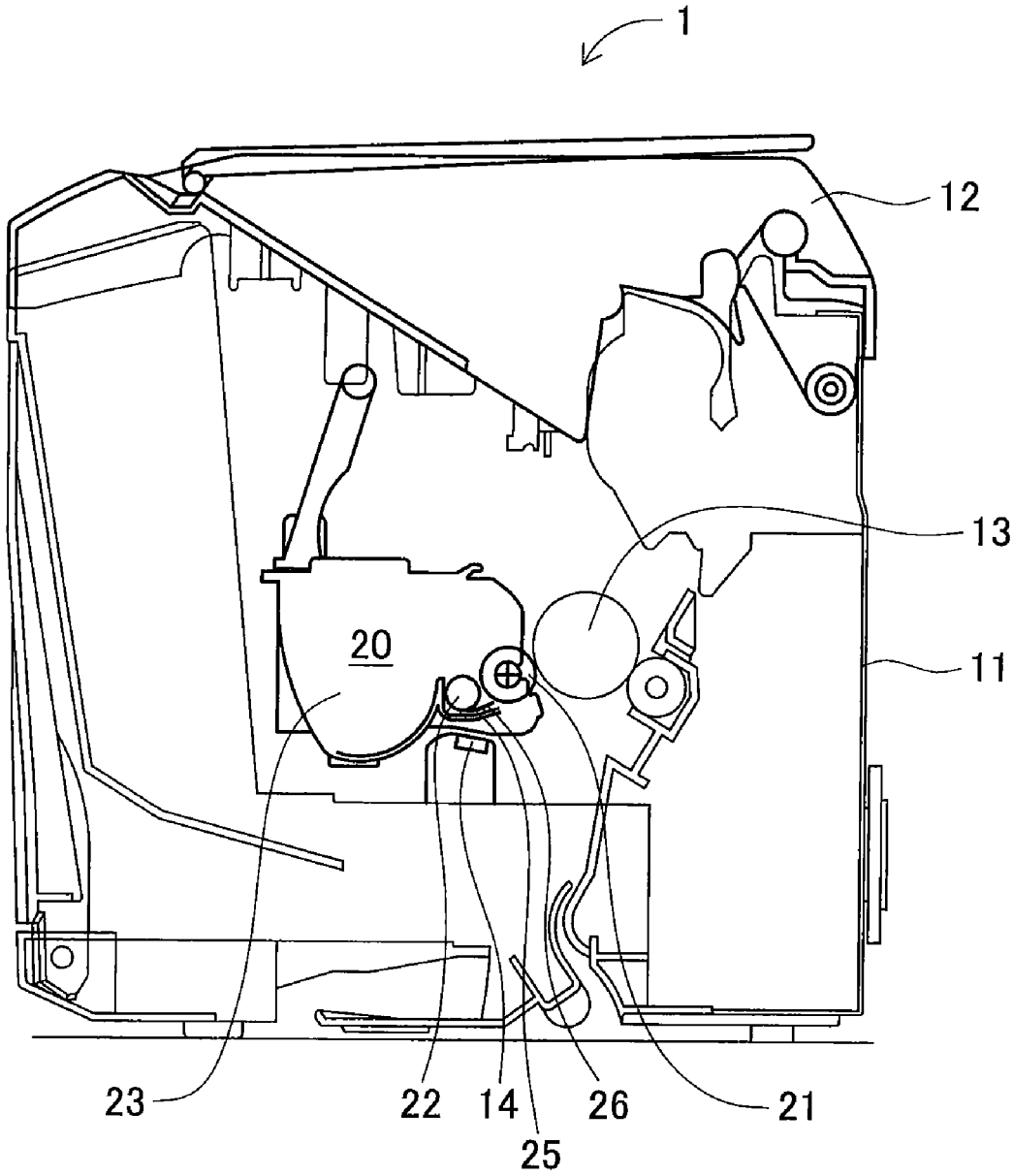
FIG. 1 is a cross sectional view of an image forming apparatus directed to a first embodiment.
Figure 2:
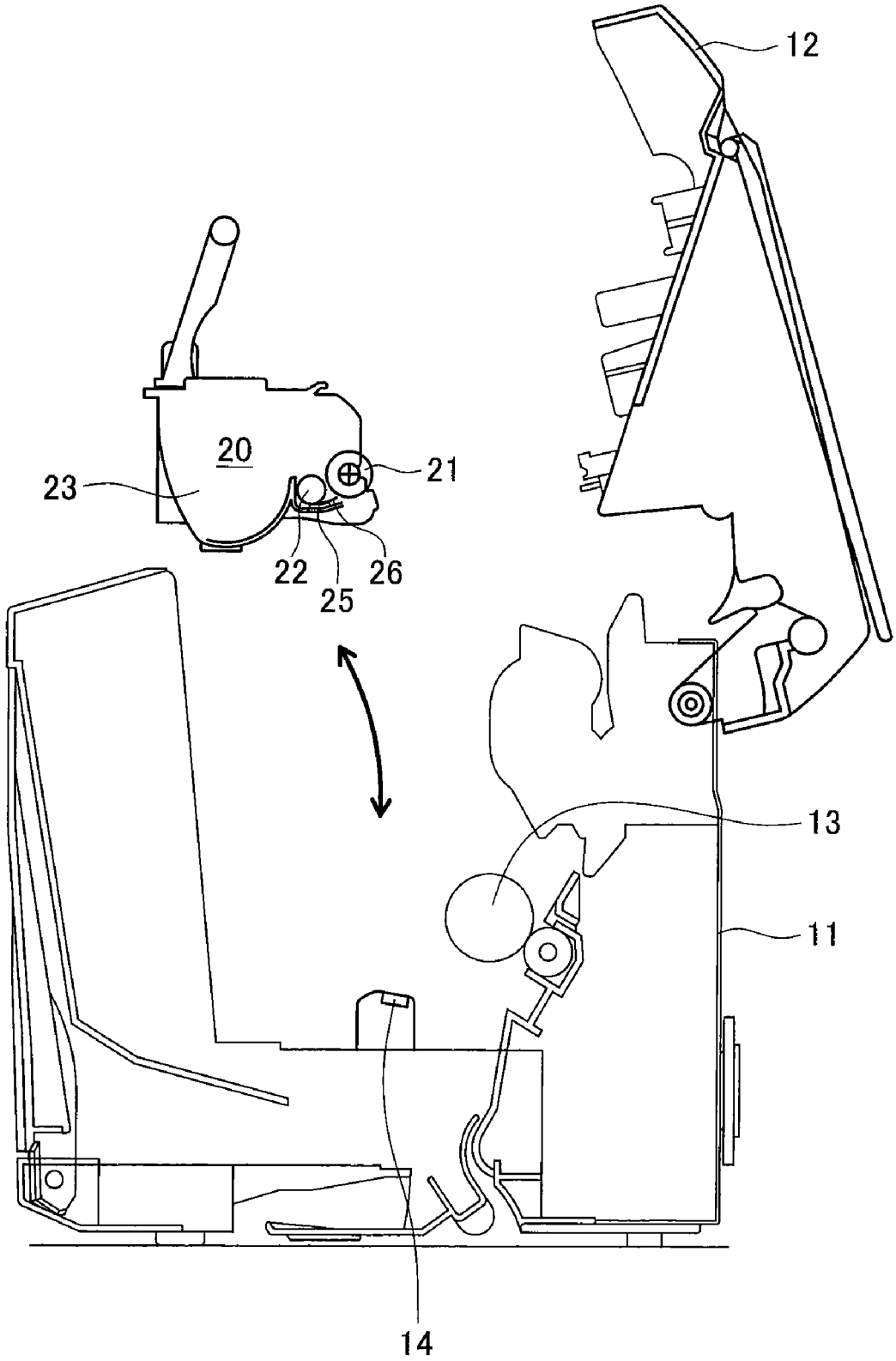
FIG. 2 is another cross sectional view of the image forming apparatus directed to the first embodiment.

As schematically shown in FIG. 1, an image forming apparatus 1 has an apparatus body 11 and a cover 12 which pivots when being opened or closed, and a cartridge 20 which is detachable and attachable is loaded therein. Toner is housed in the cartridge 20. When the cover 12 of the apparatus body 11 is opened, the cartridge 20 can be detached from and attached to the apparatus body 11 as indicated with an arrow in FIG. 2. It is to be noted that the apparatus body 11 has a photosensitive body 13, which means the image forming apparatus 1 is an electrophotographic type. Structure of respective portions for image formation, operations, display, and the like is same as one commonly used. Therefore, those portions are depicted in simplified forms and descriptions of them will be omitted.

Figure 3:
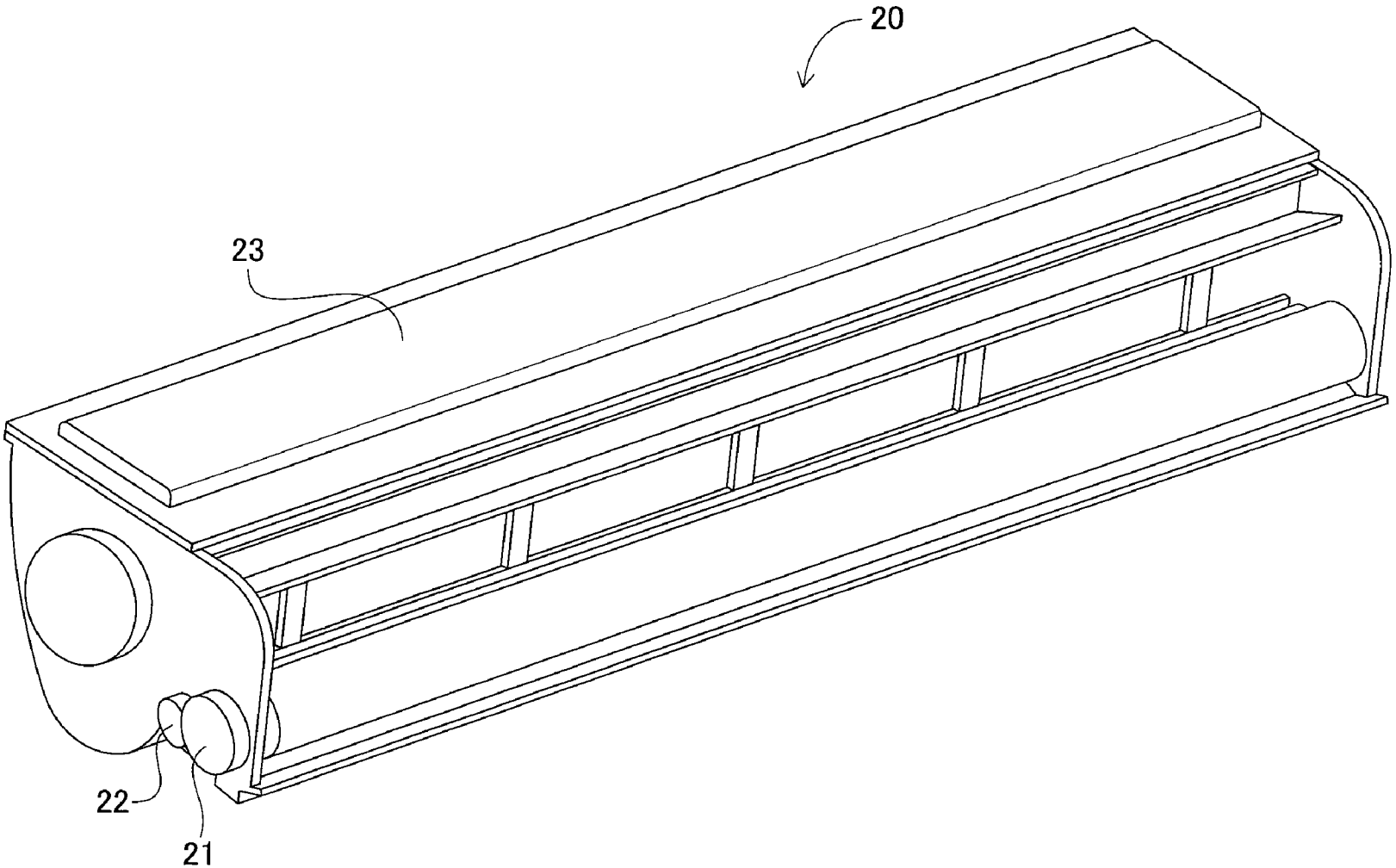
FIG. 3 is a perspective view of a cartridge.

As shown in FIG. 3, the cartridge 20 is a developer cartridge which comprises a development roller 21, a supply roller 22 and a toner reservoir 23. While the cartridge 20 is attached to the apparatus body 11, the development roller 21 approximates to the photosensitive body 13 to feed toner onto a surface of the photosensitive body 13. The supply roller 22 supplies toner to the development roller 21. Toner inside of the toner reservoir 23 is agitated by a suitable agitating member. The development roller 21, the supply roller 22 and the agitating member are rotated without exception at least at the time of image formation. Accordingly, all shafts of those rotating items are equivalent to a rotating shaft.

In the cartridge 20 of the present embodiment, a storage unit 25 is provided at a lower portion of the supply roller 22 in FIG. 1. Information unique to the cartridge 20 has previously been stored in the storage unit 25. Inside the apparatus body 11 of the image forming apparatus 1, a communication unit 14 is provided. As shown in FIG. 1, the communication unit 14 is provided on a location to face the storage unit 25 when the cartridge 20 is attached. Both the storage unit 25 and the communication unit 14 of the apparatus body 11 have wireless communication function and they can communicate with each other. That is, the storage unit 25 and the communication unit 14 correspond to a cartridge-side communication unit and an apparatus-side communication unit, respectively.

It is to be noted that the communication function between the communication unit 14 and the storage unit 25 is not so strong: they can communicate with each other only when a distance between the communication unit 14 and the storage unit 25 is within a predetermined range. For example, as long as the cartridge 20 is appropriately attached to the apparatus body 11 as shown in FIG. 1, the distance between the communication unit 14 and the storage unit 25 is set within a communicable range. However, in case the cartridge 20 is placed outside of the apparatus body 11, they cannot communicate with each other even though the cartridge 20 is placed just beside the apparatus body 11. Accordingly, the apparatus body 11 can detect complete attachment of the cartridge 20 by communicating with the storage unit 25 through the communication unit 14.

Cartridge information stored in the storage unit 25 contains, for example, a serial number, model information, area information, new-or-used information, cumulative printed sheet number information, and the like. The serial number corresponds to a sign unique to the cartridge 20. The model information indicates model name(s) of apparatus(es) to which the cartridge 20 is attachable. The area information indicates areas where the cartridge 20 can be used. That is, since there is particular specification difference depending on area even among image forming apparatuses defined as same model, the area information is used to check if it is effective in this area. The new-or-used information is to indicate whether or not the cartridge 20 is an unused new one. The cumulative printed sheet number information is to be added to a not-new cartridge and equivalent to the cumulative number of sheets already used for printing. Furthermore, in case of a multi-color image forming apparatus, color information to indicate colors of toner housed there. It is to be noted that, except new-or-used information and cumulative printed sheet number information, the above mentioned information are permanent ones.

When the cartridge 20 is attached to the apparatus body 11, the image forming apparatus 1 of the present embodiment reads out unique information of the cartridge 20 from its storage unit 25. The image forming apparatus 1 checks if whether or not the model information and the area information are agreeable with the apparatus body 11, and further checks whether or not the cartridge 20 is new one by referring to the new-or-used information. In case recognizing it as not-new one, the image forming apparatus 1 checks if there remains a certain extent of toner by referring to the cumulative printed sheet number information. In case recognizing that the cumulative printed sheet number information exceeds a predetermined number, the image forming apparatus 1 determines that the cartridge 20 currently attached there has been consumed. In that case, the image forming apparatus 1 indicates necessity of cartridge change in a display of the apparatus body 11 and does not carry out image formation any more. In case of the multi-color image forming apparatus, the apparatus checks if the cartridge 20 is attached to a right position by referring to the color information. Once all of the unique information of the cartridge 20 has been confirmed, the image forming apparatus 1 becomes available to image formation and stands-by.

Figure 4:
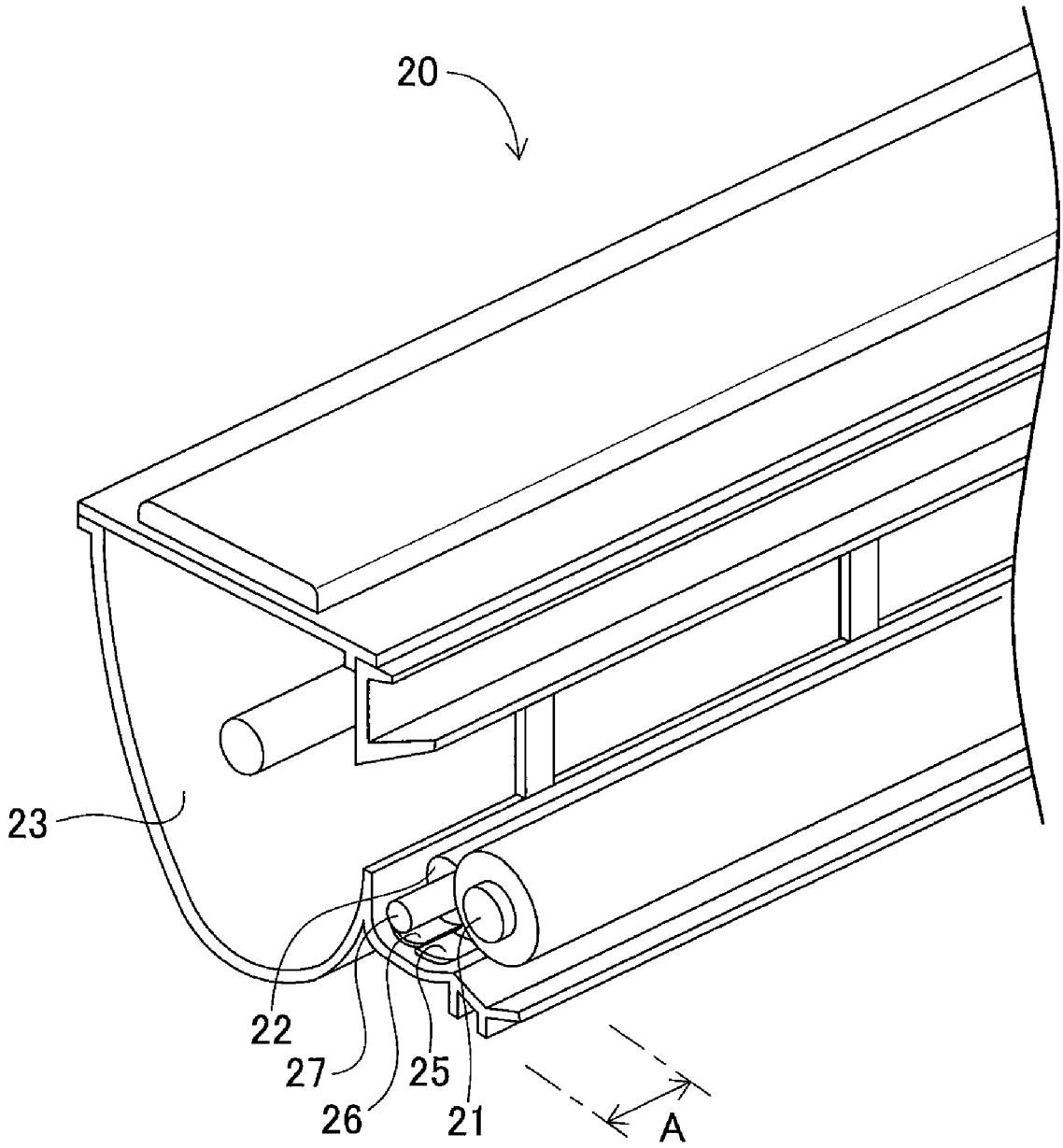
FIG. 4 is a perspective view of the cartridge with its periphery detached.

In the present embodiment, not entirety of the supply roller 22 with reference to an axial direction is used for image formation. However, as shown in FIG. 4, there is a non-image-formation region A at one of ends of the axial direction. A side of an elastic member 26 is fixed to a portion within the non-image-formation region A of a rotating shaft 27 of the supply roller 22. The elastic member 26 is a substantially rectangular-shaped sheet member with elasticity. Its fixed side rotates along with rotation of the supply roller 22. Other three sides are not fixed anywhere. Therefore, the elastic member 26 rotates around the rotating shaft 27 along rotation of the rotating shaft 27. It is to be noted that the elastic member 26 corresponds to a bendable member. FIG. 4 shows an axial direction end portion of the cartridge 20 shown in FIG. 3 with its side panel removed.

Furthermore, in the present embodiment, the storage unit 25 is lightly adhered and fixed to a case wall of the cartridge 20 below the supply roller 22 in FIG. 4. The storage unit 25 is also arranged in the non-image-formation region A with reference to the axial direction, as shown in FIG. 4, and so is the elastic member 26. The case wall of this portion is formed comparatively closer to the outer periphery of the supply roller 22. A length of the elastic member 26 in a vertical direction with reference to rotating axis is made lager than a distance between the rotating shaft 27 of the supply roller 22 and the storage unit 25. This means that the storage unit 25 is arranged on a location which enables the storage unit 25 to get contract with the elastic member 26 along rotation of the supply roller 22.

Figure 5:
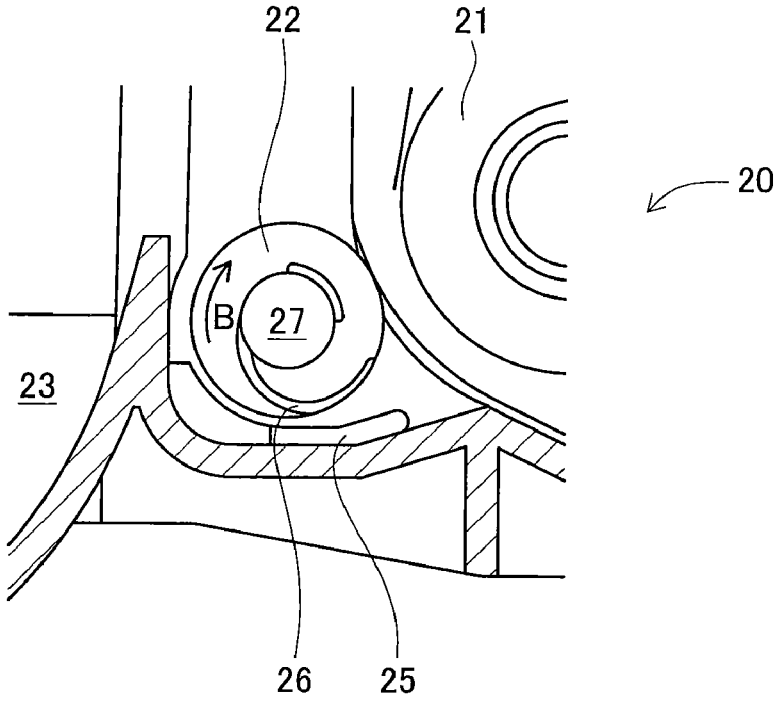
FIG. 5 is a diagram showing an inside state of the cartridge which holds much toner.
Figure 6:
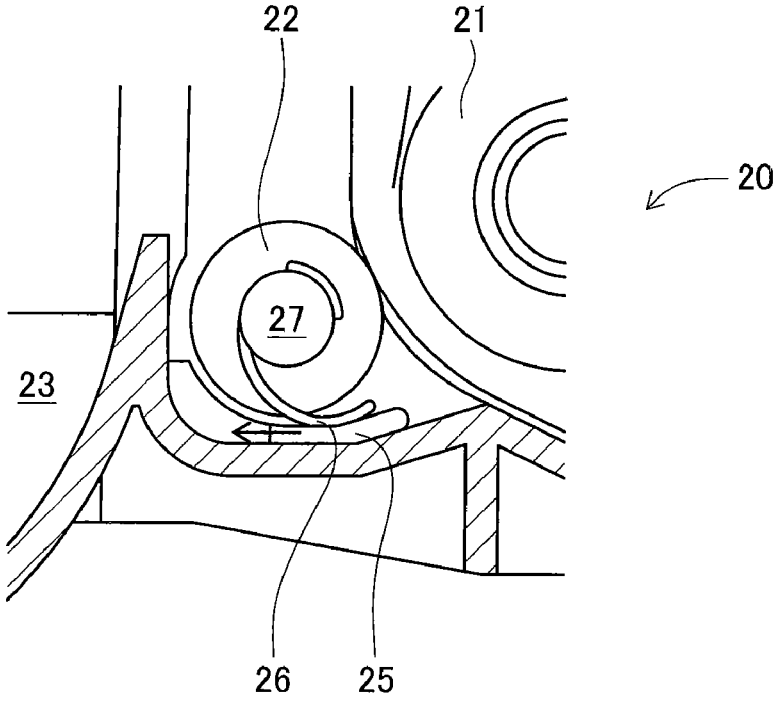
FIG. 6 is a diagram showing an inside state of the cartridge which holds a little toner.

At the time of image formation, the supply roller 22 is rotated in an arrow B direction, as shown in FIG. 5. The elastic member 26 is rotated along rotation of the rotating shaft 27 of the supply roller 22. When the toner reservoir 23 of the cartridge 20 holds much toner, surroundings of the supply roller 22 are almost filled with toner. In case surroundings of the supply roller 22 are filled with toner, an unfixed portion of the elastic member 26 is pushed up by toner and rotated with being bent backward, as shown in FIG. 5. In FIG. 5, toner itself is not depicted. Accordingly, the elastic member 26 does not come to contact with the storage unit 25 even at the time of image formation. FIG. 5 and FIG. 6 show the surroundings of the supply roller 22, which is what FIG. 4 is viewed from the lower left side.

Amount of toner housed in the toner reservoir 23 decreases gradually due to accumulative image formation. When toner decreases to a certain extent of amount, it turns to be a state that the surroundings of the supply roller 22 are not filled with toner. As a result of absence of toner to fill the surroundings, the elastic member 26 bent backward due to toner regains its original form with its elastic force. When the rotating shaft is rotated, a front end portion of the elastic member 26 with regaining its original form comes to contact with the storage unit 25. After getting contact with the elastic member 26, the storage unit 25 is pushed in an arrow direction in FIG. 6 due to elastic force and rotation of the elastic member 26.

Being only lightly adhered to the case wall, the storage unit 25 is pushed by the elastic member 26 and removed from the case wall. As a result, the communication state deteriorates. Generally, the storage unit 25 can not communicate with the apparatus body 11 any more. This is because a distance between the storage unit 25 and the communication unit 14 has become long or because the storage unit 25 gets out of the sight of the communication unit 14. Since the apparatus body 11 constantly communicates with the storage unit 25 through the communication unit 14, the apparatus body 11 can detect the change of the communication state. Upon detecting the change, the apparatus body 11 determines that residual toner has become little and indicates an appropriate warning sign.

Since the supply roller 22 keeps rotating during image formation, the storage unit 25 never returns to its original location. Once detecting the deterioration of communication state, the apparatus body 11 may keep indicating a warning sign until the cartridge 20 is replaced with a new one. In this connection, the location of the storage unit 25, and relations of size, adhesiveness and elasticity of the elastic member 26 are appropriately set so that amount of residual toner to make communication state deteriorated can coincide with reference amount for judging whether or not amount of residual toner is acceptable for further image formation use.

As described in detail, according to the image forming apparatus 1 of the present embodiment, the storage unit 25 is moved by the elastic member 26 when amount of residual toner becomes little. This causes deterioration of communication state and enables the apparatus body 11 to detect that amount of residual toner is little. It is the elastic member 26 that is only and newly added for residual-toner-amount detection as composing element. Extra space is not required for the elastic member. Additionally, since the storage unit 25 is provided inside the cartridge 20, such a location keep it out from a user's reach as well as damage and removal by a user's hand. Accordingly, there is provided the developer cartridge and image forming apparatus surely capable of carrying out both residual-toner-amount detection and transmission of cartridge information with space saving design. It is also applicable to provide a connecting portion on an outer face of the cartridge 20 so that the communication unit 14 and storage unit 25 can communicate with each other by wire.

Second Embodiment

A second embodiment will be described in detail with reference to the accompanying drawings. Instead of the elastic member 26 employed in the first embodiment, the second embodiment employs a different type bendable member which is a main difference from the first embodiment. Additionally, a location of a storage unit with reference to a cartridge and that of a communication unit with reference to an apparatus body are slightly different in comparison with the first embodiment. Accordingly, same numerals are assigned to portions common to the first and second embodiments and description on them will be omitted. It is assumed that, in the second embodiment and all of the other following embodiments, any storage units to be arranged on respective cartridges are located within a non-image-formation region A (see FIG. 4). Furthermore, contents stored in the storage unit and communication ability of the respective embodiments are similar to that of the storage unit 25 employed in the first embodiment.

Figure 7:
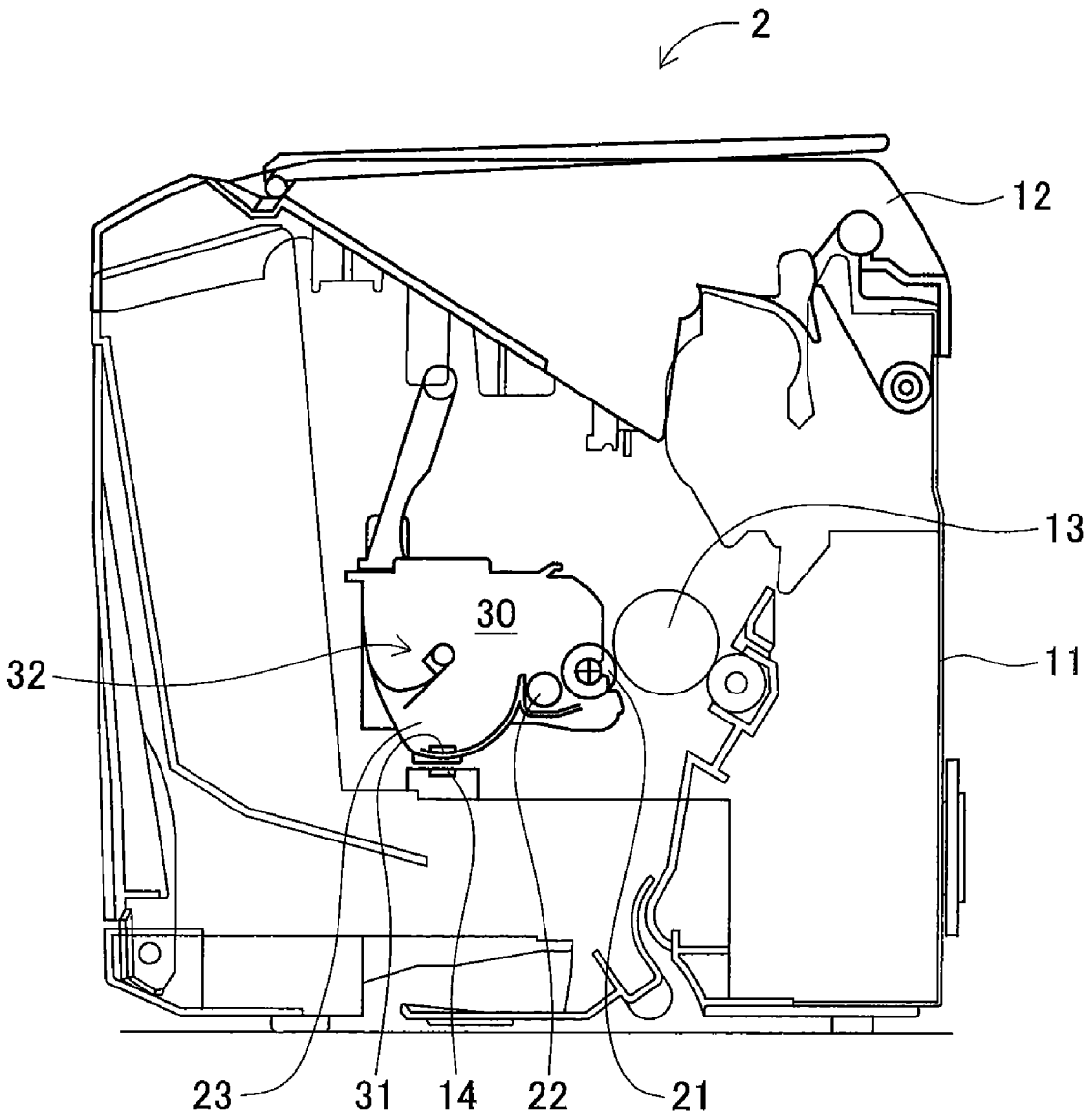
FIG. 7 is a cross sectional view of an image forming apparatus directed to a second embodiment.

As shown in FIG. 7, an image forming apparatus 2 of the second embodiment comprises an apparatus body 11 and a cartridge 30. In the present embodiment, a storage unit 31 of the cartridge 30 is lightly adhered to an inner bottom portion of a toner reservoir 23. A communication unit 14 of the apparatus body 11 is arranged on a location corresponding with the storage unit 31. Furthermore, an agitating member 32 is provided in the toner reservoir 23 of the cartridge 30.

Figure 8:
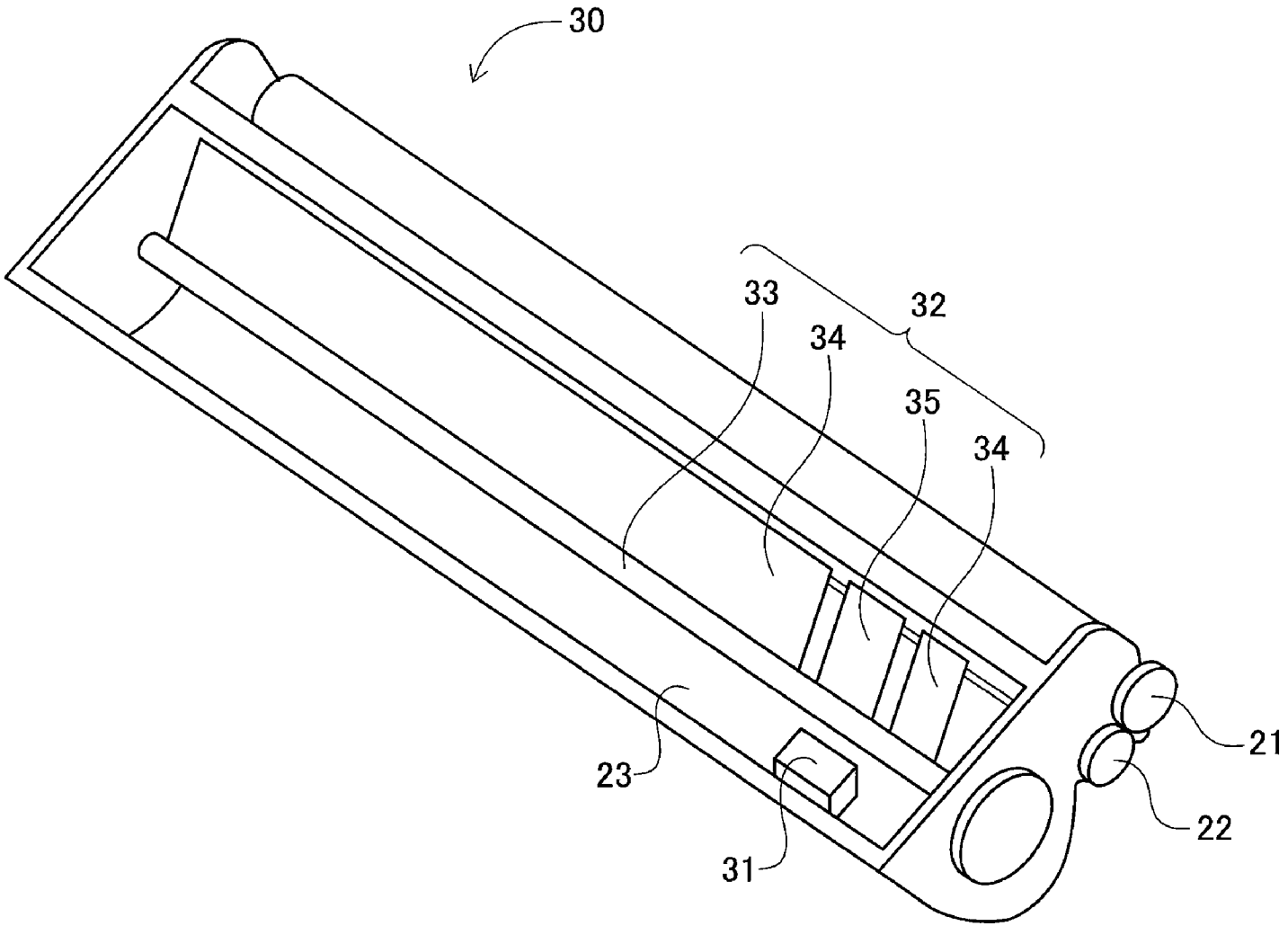
FIG. 8 is a perspective view of a cartridge directed to the second embodiment.

As shown in FIG. 8, the agitating member 32 comprises a rotating shaft 33, agitating plates 34, and an elastic member 35. One of sides of the respective agitating plates 34 and one of sides of the elastic member 35 are fixed to the rotating shaft 33 and rotate altogether. The elastic member 35 has flexibility and corresponds to a bendable member. Furthermore, the elastic member 35 is arranged on a location which enables the elastic member 35 to get contact with the storage unit 31 along rotation of the rotating shaft 33. It is to be noted that the agitating plates 34 have little flexibility and do agitate toner in the toner reservoir 23 along rotation of the rotating shaft 33. FIG. 8 is a perspective view of the cartridge 30 with its lid removed.

Figure 9:
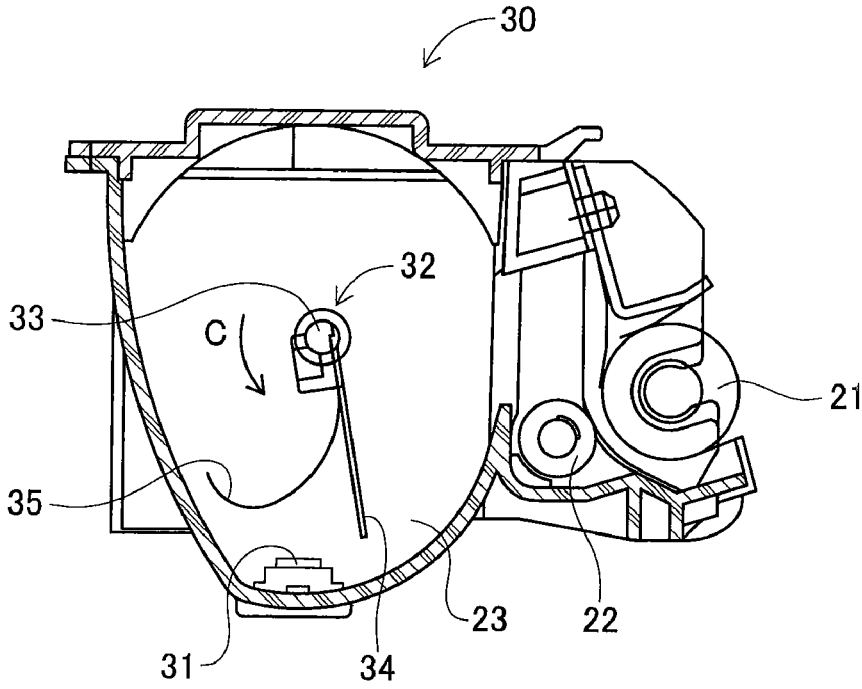
FIG. 9 is a diagram showing an inside state of the cartridge directed to the second embodiment which holds much toner.
Figure 10:
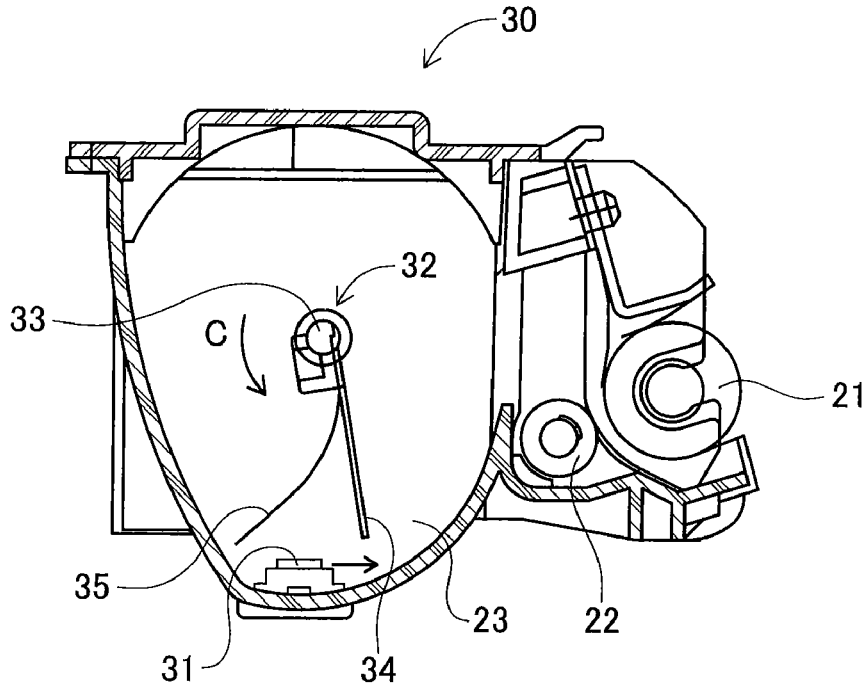
FIG. 10 is a diagram showing an inside state of the cartridge directed to the second embodiment which holds a little toner.

When image formation is carried out by the image forming apparatus 2, the agitating member 32 of the cartridge 30 is rotated in an arrow C direction, as shown in FIG. 9 and FIG. 10. What is depicted in FIG. 9 is an inside state of the toner reservoir 23 which holds much toner. However, toner itself is not depicted there. Being pushed backward by toner, the elastic member 35 is rotated with being bent backward. Accordingly, the elastic member 35 does not get contact with the storage unit 31 in this state.

As amount of toner lessens, the elastic member 35 does not get bent backward so much as before as shown in FIG. 10 because amount of toner is too little to push the elastic member 35 backward. As a result, the elastic member 35 comes to contact with the storage unit 31 along rotation of the rotating shaft 33. Then, a rightward force is applied to the storage unit 31 in FIG. 10. Being only lightly adhered to the inner bottom portion of the toner reservoir 23, the storage unit 31 is removed in a rightward direction as shown with an arrow in FIG. 10. Thereby, the communication state deteriorates. This is because a distance between the storage unit 31 and the communication unit 14 has become longer or because the storage unit 31 gets out of the sight of the communication unit 14.

The location of the storage unit 31, and relations of size, adhesiveness and elasticity of the elastic member 35 are appropriately set so that amount of residual toner to make communication state deteriorated can coincide with reference amount for judging whether or not amount of residual toner is acceptable for further image formation use. Since such mechanism enables the apparatus body 11 to determine that amount of residual toner lowers to the reference amount, the apparatus body 11 carries out a toner-extinction warning processing. Once the adhesion is removed from the wall, the storage unit 31 is cast away in toner. Therefore, the deteriorated communication state never gets back normal. In case a member with flexibility is employed as agitating plate 34, it is possible to allow a part of the agitating plate 34 with flexibility to work as elastic member 35.

As described in detail, similar to the first embodiment, the image forming apparatus 2 of the second embodiment realizes the developer cartridge and image forming apparatus surely capable of carrying out both residual-toner-amount detection and transmission of cartridge information with space saving design. Incidentally, it is applicable that the communication unit 14 and the storage unit 31 communicate with each other by wire.

Third Embodiment

A third embodiment will be described in detail with reference to the accompanying drawings. A location of a storage unit with reference to a cartridge, structure around this item and a location of a communication unit with reference to an apparatus body are slightly different in comparison with the first embodiment. Accordingly, same numerals are assigned to portions common to the first and third embodiments and description on them will be omitted.

Figure 11:
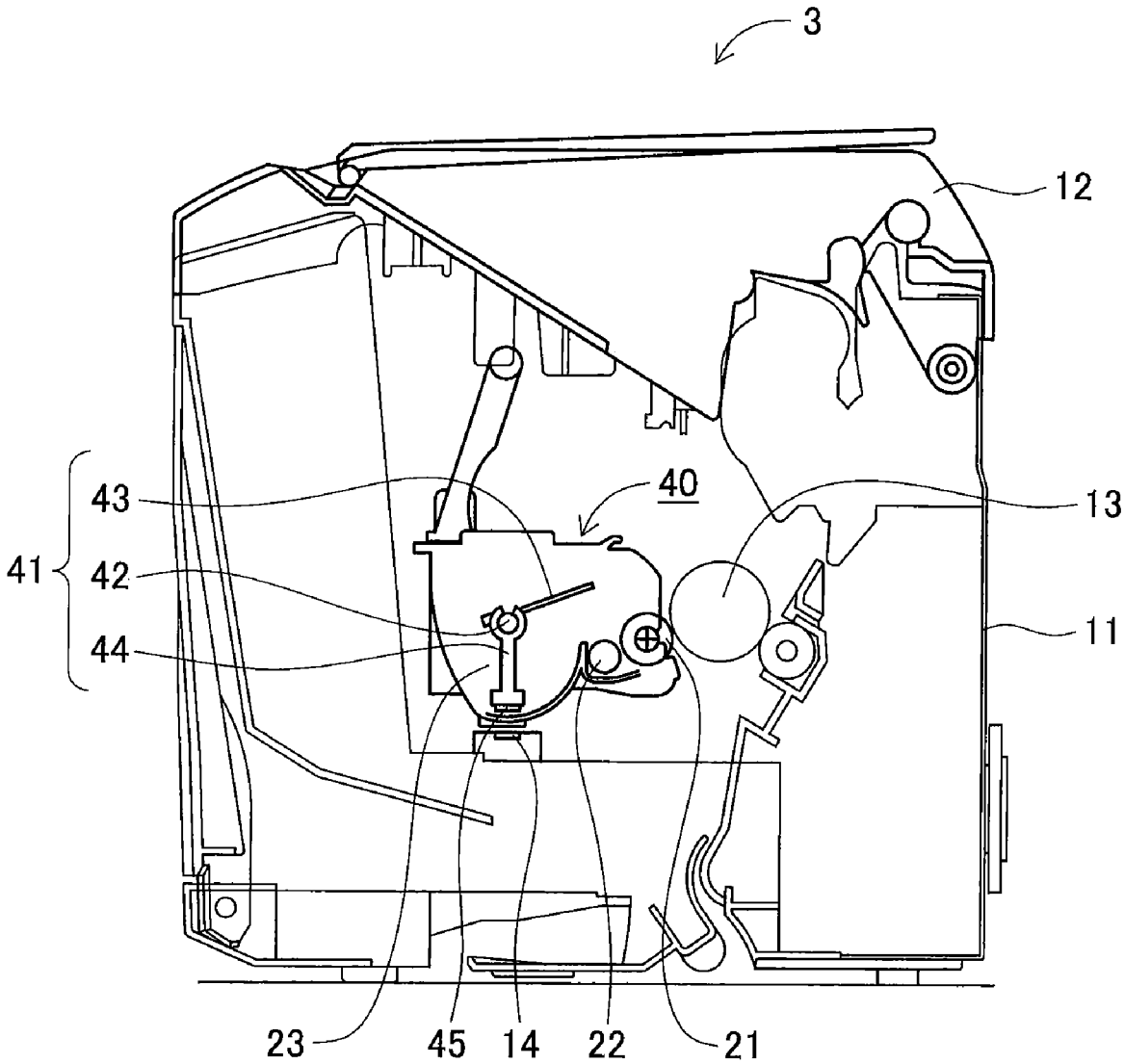
FIG. 11 is a cross sectional view of an image forming apparatus directed to a third embodiment.

As shown in FIG. 11, an image forming apparatus 3 of the third embodiment comprises an apparatus body 11 and a cartridge 40. In this embodiment, an agitating member 41 is provided inside a toner reservoir 23 of the toner cartridge 40. The agitating member 41 comprises a rotating shaft 42, an agitating plate 43, and a rocking member 44. A storage unit 45 is attached to a bottom end portion of the rocking member 44. When the rocking member 44 heads downward as shown in FIG. 11, the storage unit 45 is located near the bottom face of the toner reservoir 23. Furthermore, a communication unit 14 of the apparatus body 11 is arranged on a location corresponding with the storage unit 45.

Figure 12:
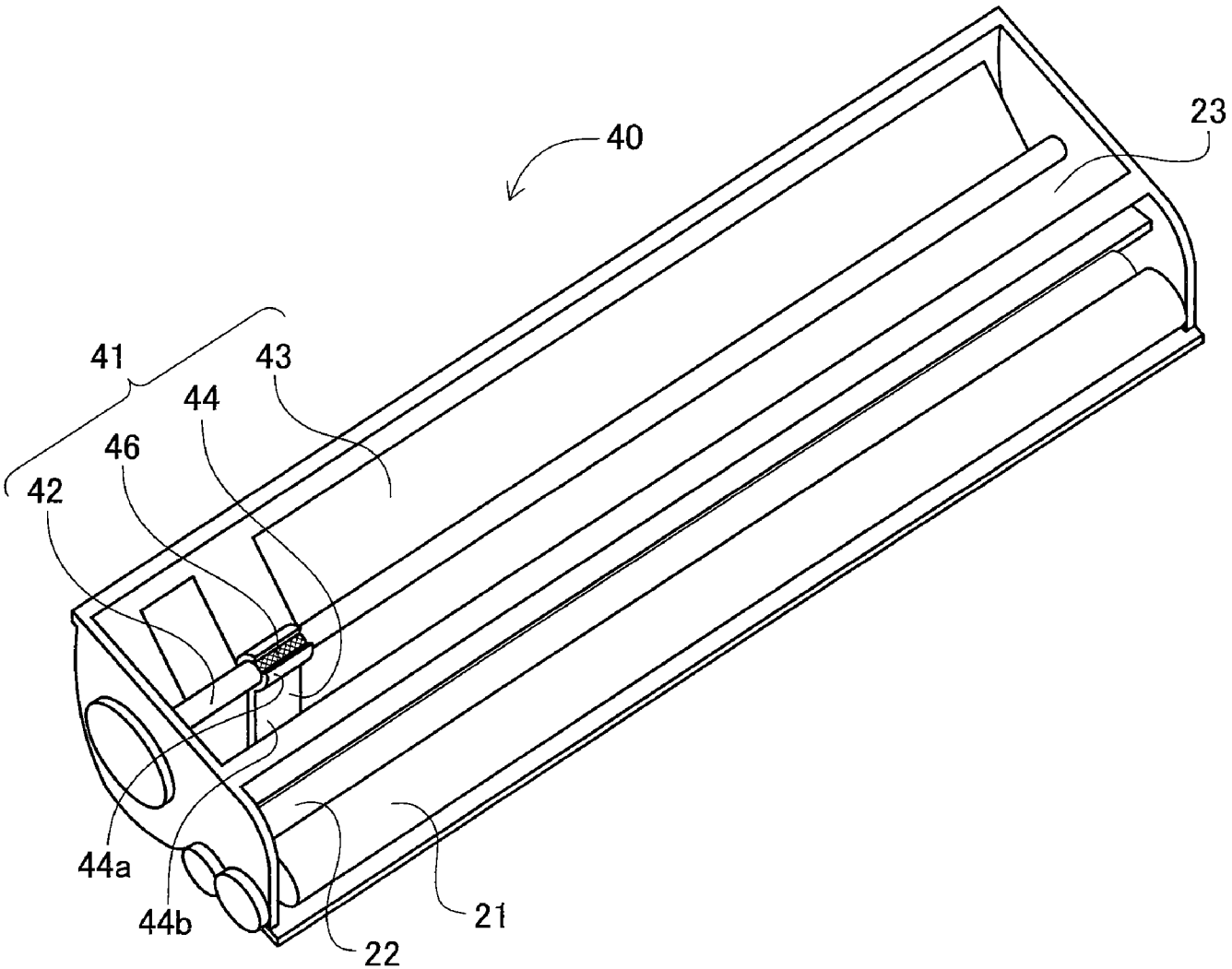
FIG. 12 is a perspective view of a cartridge directed to the third embodiment.
Figure 13:
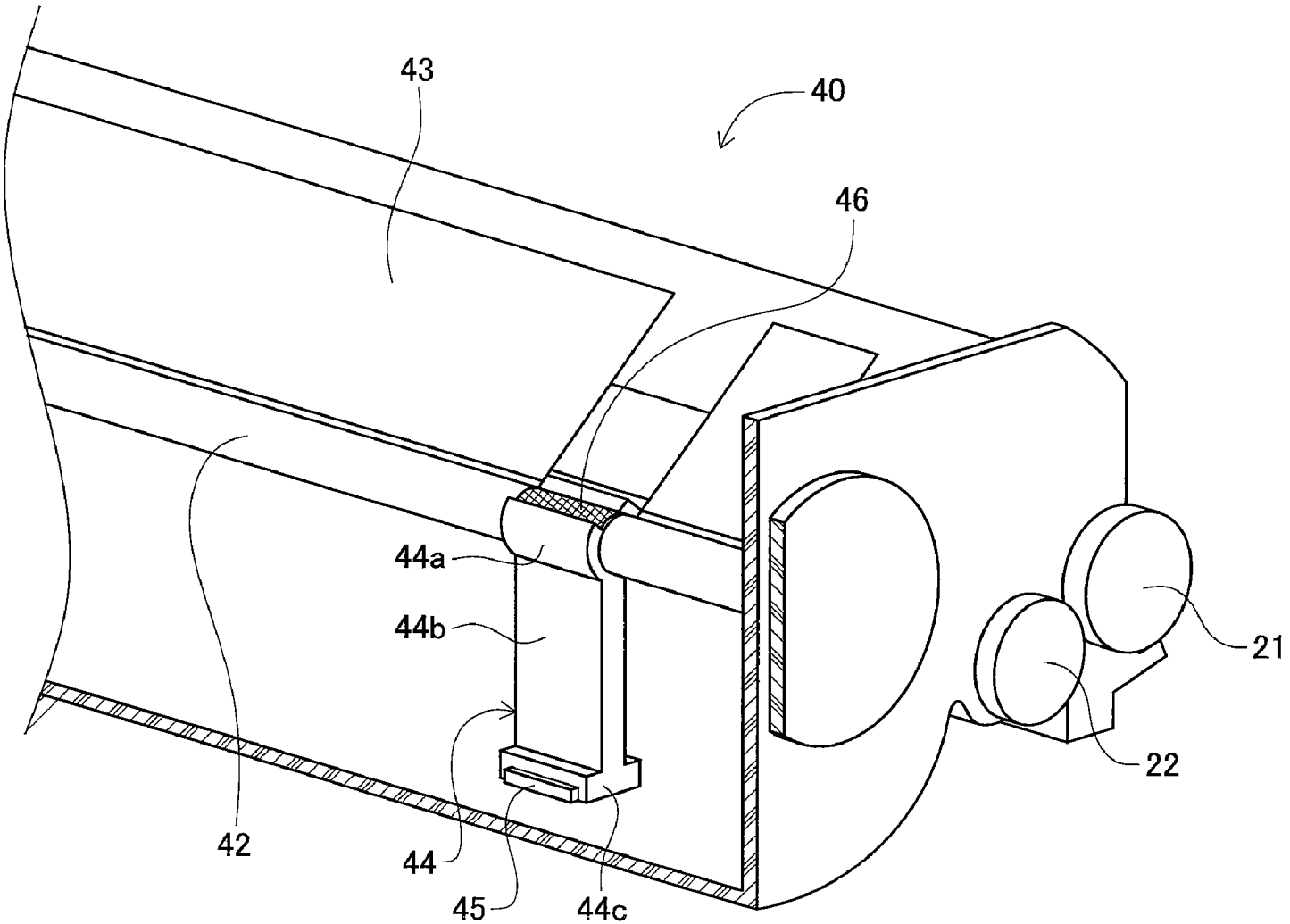
FIG. 13 is a cross sectional view of the cartridge directed to the third embodiment.

A shown in FIG. 12 and FIG. 13, the rocking member 44 comprises a cylindrical portion 44*a*, an intermediate portion 44*b*, and a lower end portion 44*c*. A rotating shaft 42 penetrates through the inner circumference of the cylindrical portion 44*a*. Since the cylindrical portion 44*a* and the rotating shaft 42 are not fixed to each other, they can slide and rotate individually. Furthermore, a friction member 46 is provided between the inner circumference of the cylindrical portion 44*a* and the outer circumferential of the rotating shaft 42. Therefore, when the rotating shaft 42 is driven for rotation, torque is transmitted to the cylindrical portion 44*a* by frictional force of the friction member 46. The storage unit 45 is fixed on the bottom surface of the lower end portion 44*c* as shown in FIG. 13. It is to be noted that the cross sectional shape of the cylindrical portion 44*a* may be a partially-lacked circular shape or may be a complete circle.

Figure 14:
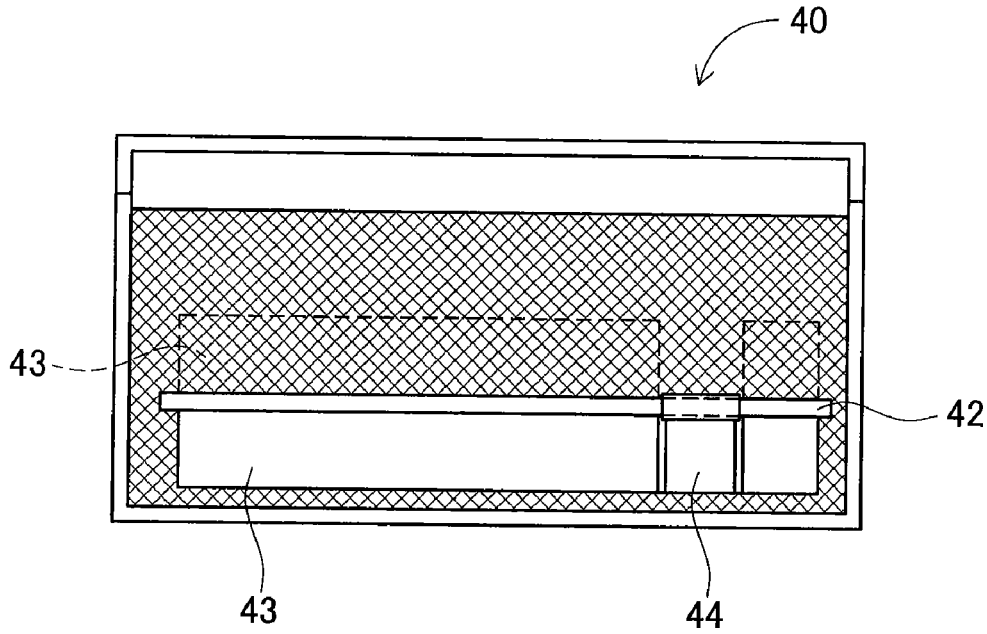
FIG. 14 is a diagram showing an inside state of the cartridge directed to the third embodiment which holds much toner.

When image formation is carried out by the image forming apparatus 3, the agitating member 41 of the cartridge 40 is rotated along rotation of the rotating shaft 42. When the toner reservoir 23 holds much toner, rock of the rocking member 44 is suppressed due to the presence of much toner. The rocking member 44 slides with reference to the rotating shaft 42 against frictional force of the friction member 46, and rotates little. That is, since the location of the storage unit 45 varies little, preferable communication state is kept. Furthermore, since only the rotating shaft 42 and the agitating plate 43 rotate, only the location of agitating plate 43 varies as shown in FIG. 14. In FIG. 14, the agitating plate 43 indicated with continuous lines corresponds to the agitating plate 43 heading downward, and the agitating plate 43 indicated with dotted lines corresponds to the agitating plate 43 heading upward. However, the rocking member 44 is constantly located at the position indicated with continuous line wherever the agitating plate 43 may be located.

Figure 15:
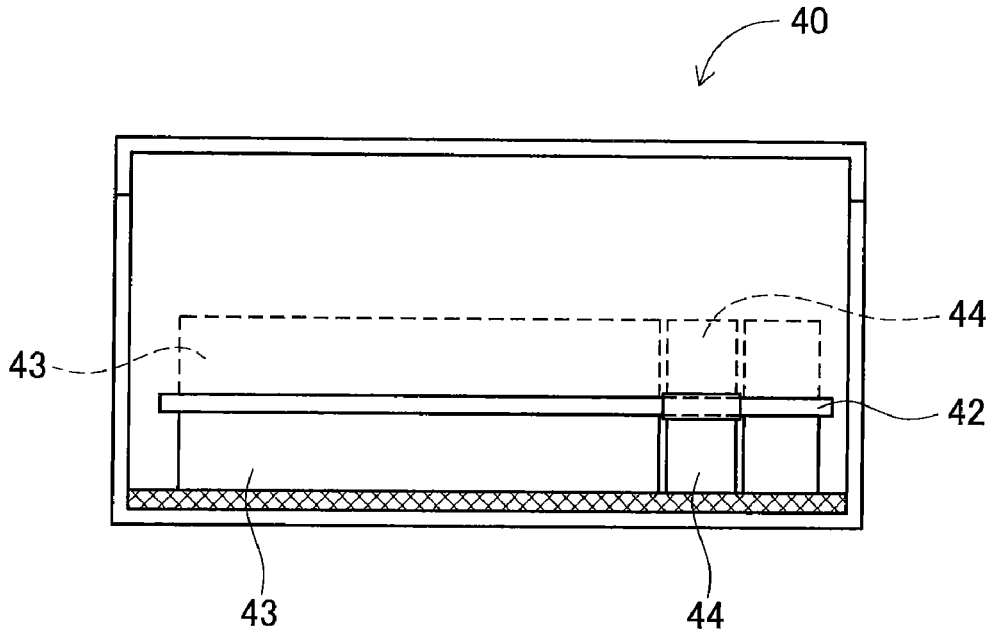
FIG. 15 is a diagram showing an inside state of the cartridge directed to the third embodiment which holds a little toner.

As amount of toner lessens, toner's force to suppress rock of the rocking member 44 gets significantly weaker. As a result, frictional force of the friction member 46 surpasses the toner's suppressing force and the rocking member 44 rotates along rotation of the rotating shaft 42. That is, as shown in FIG. 15, the location of the rocking member 44 and that of the agitating plate 43 vary together. Since the location of the storage unit 45 varies significantly, the communication state between the storage unit 45 and the communication unit 14 of the apparatus body 11 deteriorates. Length of the rocking member 44, surface roughness of the friction member 46 are appropriately set so that amount of residual toner to make communication state deteriorated can coincide with reference amount for judging whether or not amount of residual toner is acceptable for further image formation use. This mechanism enables the apparatus body 11 to determine that amount of residual toner has lessened than the reference amount.

As described in detail, similar to the first embodiment, the image forming apparatus 3 of the third embodiment realizes the developer cartridge and image forming apparatus surely capable of carrying out both residual-toner-amount detection and transmission of cartridge information with space saving design.

Fourth Embodiment

A fourth embodiment will be described in detail with reference to the accompanying drawings. A location of a storage unit with reference to a cartridge, structure around this item and a location of a communication unit with reference to an apparatus body are slightly different in comparison with the first embodiment. Accordingly, same numerals are assigned to portions common to the first and fourth embodiments and description on them will be omitted.

Figure 16:
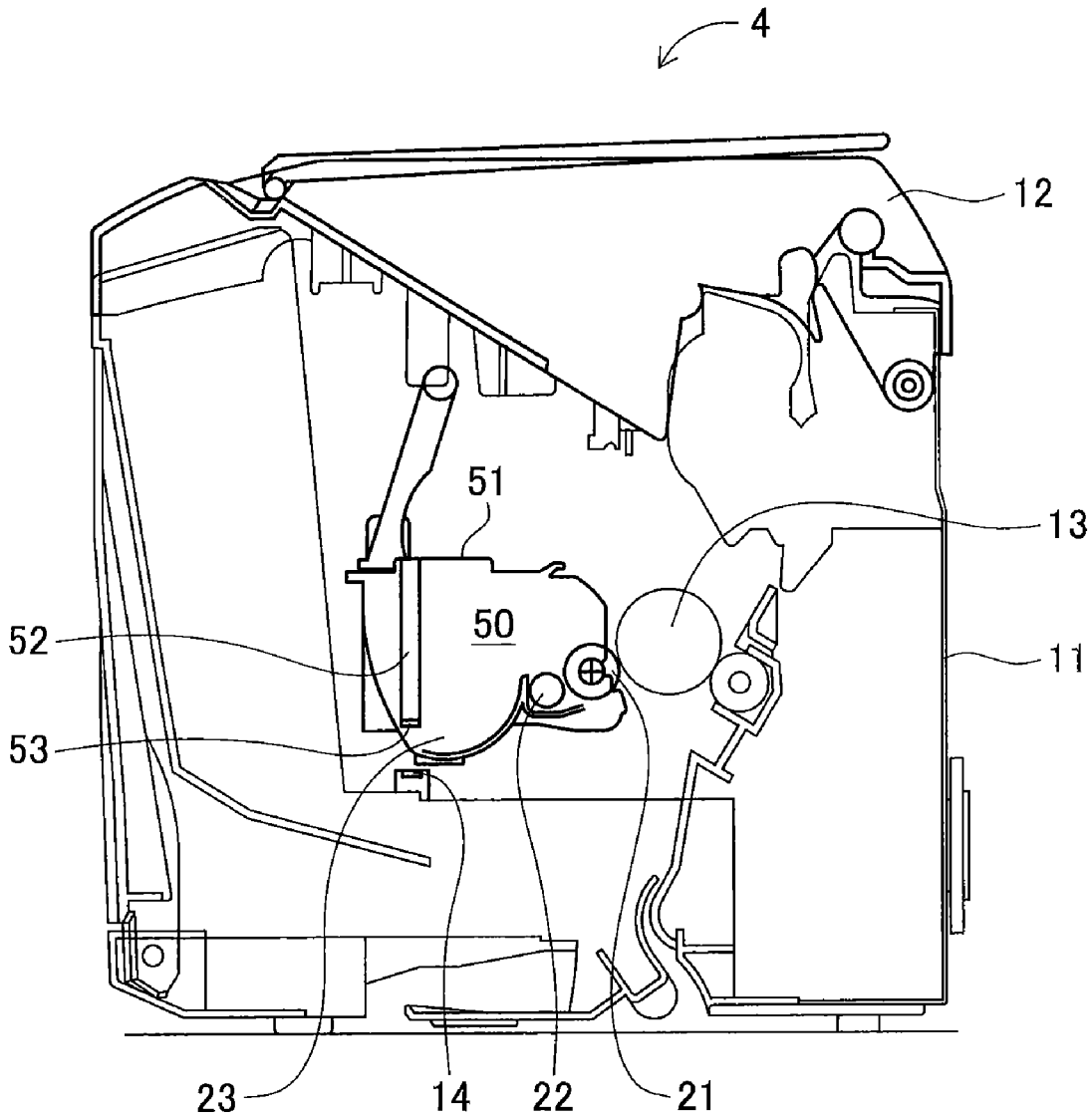
FIG. 16 is a cross sectional view of an image forming apparatus directed to a fourth embodiment.

As shown in FIG. 16, an image forming apparatus 4 of the fourth embodiment comprises an apparatus body 11 and a cartridge 50. On a lid 51 of a toner reservoir 23 of the cartridge 50, there is formed a storage unit holder 52 which protrudes downward in FIG. 16. A storage unit 53 is arranged on a lower end of the storage unit holder 52. Accordingly, the storage unit 53 is located near a bottom surface of the toner reservoir 23. Furthermore, a communication unit 14 of the apparatus body 11 is arranged on a location corresponding with the storage unit 53.

In this embodiment, electromagnetic wave is used for communication between the storage unit 53 and the communication unit 14. Since non-magnetic type toner is used, communication between the storage unit 53 and the communication unit 14 of the apparatus 11 can go without problem whether toner is present or absent between them. Actually, an agitating member such like as shown in FIG. 8 or the like for agitating toner is provided inside the toner reservoir 23.

Figure 17:
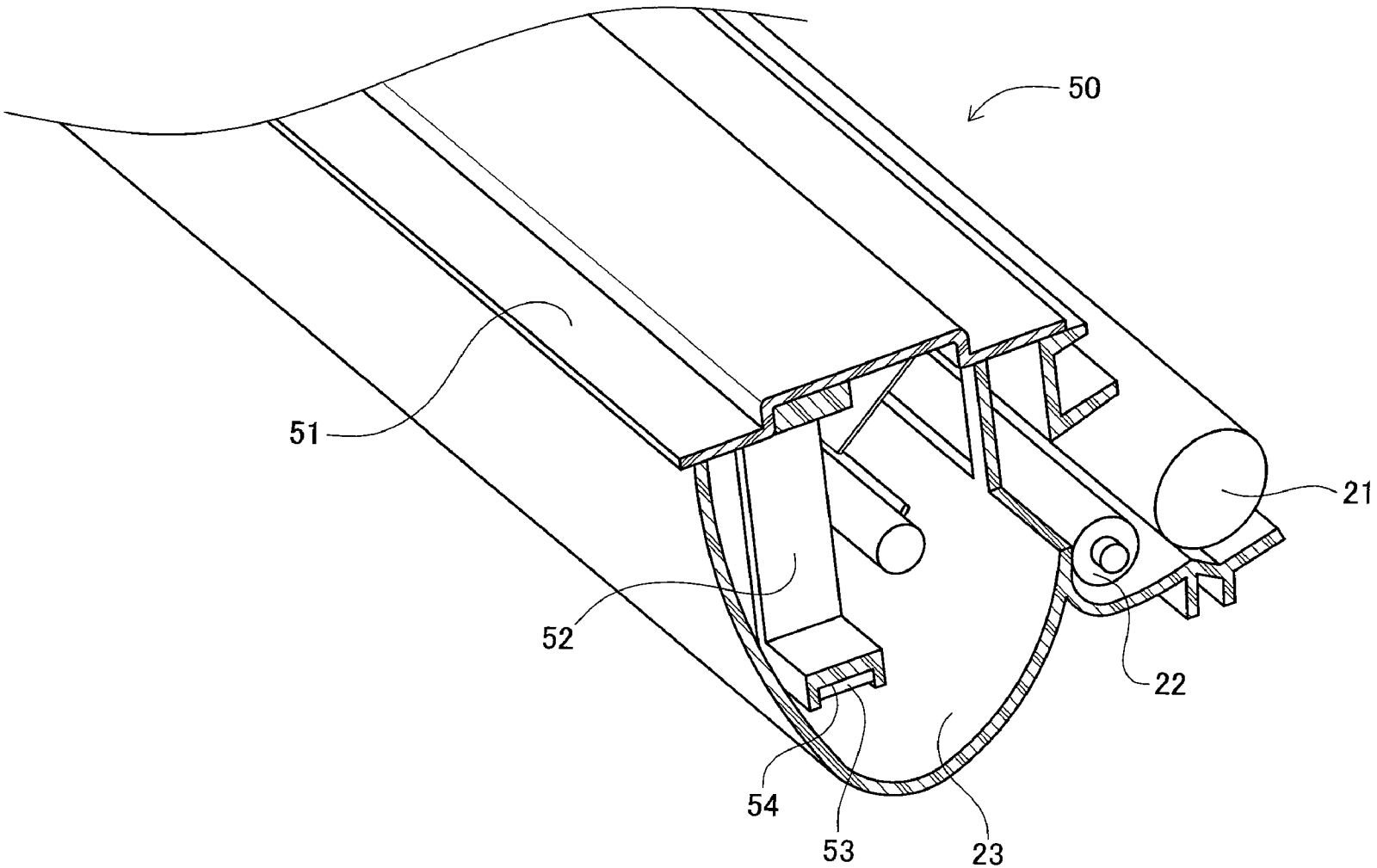
FIG. 17 is a cross sectional view of a cartridge directed to the fourth embodiment.

As shown in FIG. 17, the storage unit holder 52 is fixed on the bottom side surface of the lid 51. On the lower end surface of the storage unit holder 52, there is formed a concave portion 54 in which the storage unit can be fitted. It is to be noted that the storage unit 53 is not fixed to or not engaged with the concave portion 54, but is just fitted into there.

Figure 18:
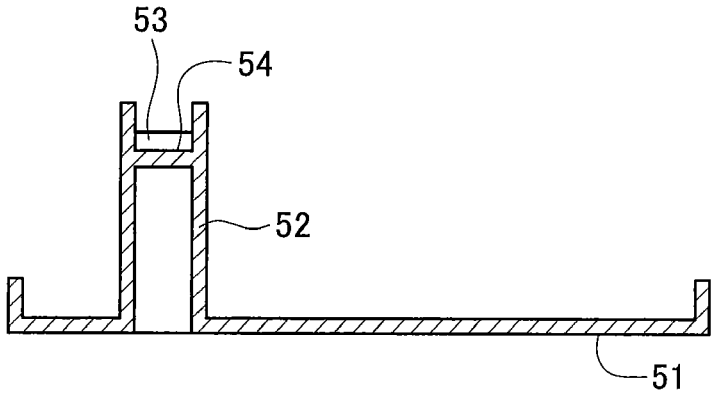
FIG. 18 is a cross sectional view of a cartridge lid directed to the fourth embodiment.
Figure 19:
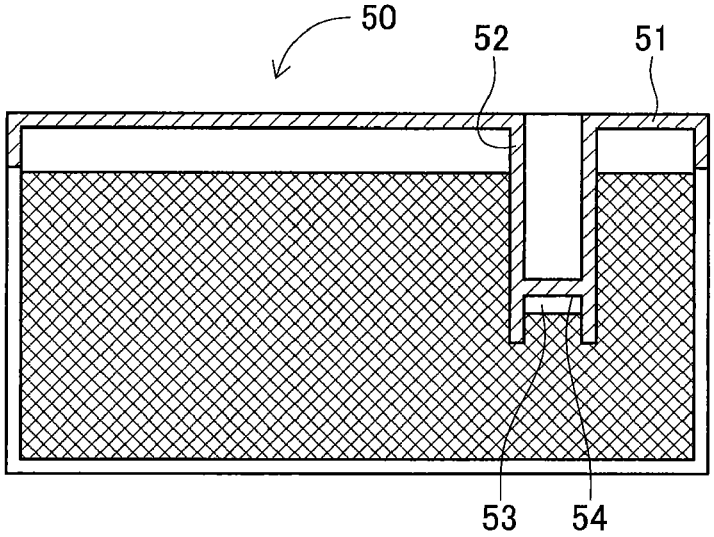
FIG. 19 is a diagram showing an inside state of the cartridge directed to the fourth embodiment which holds much toner.

In the course of manufacturing the cartridge 50, the storage unit 53 is fitted in the concave portion 54 with the lid 51 being placed upside-down, as shown in FIG. 18. The above such furnished lid 51 is attached to the cartridge 50 in which toner has been housed. At the time of the attachment, the storage unit 53 is buried into the housed toner together with the storage unit holder 52. As shown in FIG. 19, the storage unit 53 is held while the concave portion 54 is pushed against toner.

Figure 20:
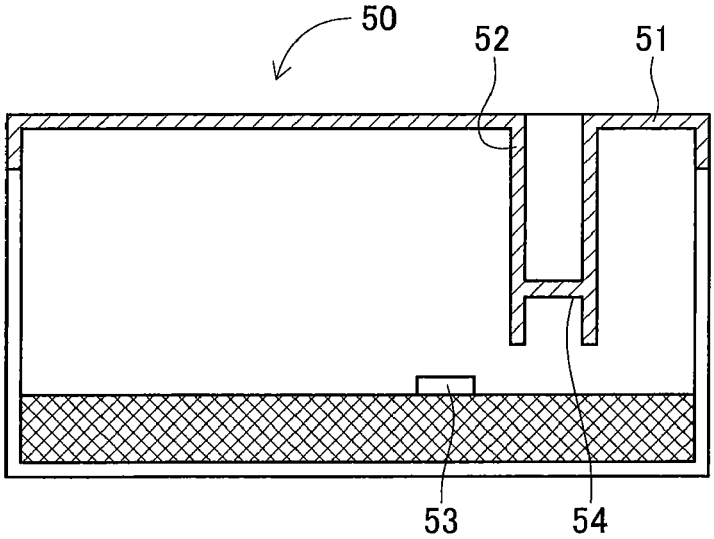
FIG. 20 is a diagram showing an inside state of the cartridge directed to the fourth embodiment which holds a little toner.

As amount of toner lessens in the course of accumulative use and the toner level in the toner reservoir 23 lowers than the level of the lower face of the storage unit 53 in FIG. 19, the storage unit 53 is no longer in a state of being supported by toner. As a result, the storage unit 53 comes off and falls down from the concave portion 54 due to its own weight. As the amount of residual toner further decreases and the storage unit 53 comes down to the level lower than the range of the concave portion 53, the storage unit 53 is cast away in toner as shown in FIG. 20. This is because toner is agitated. On that account, the communication state of the storage unit 53 deteriorates. The shape of the storage unit holder 52 is appropriately designed so that amount of residual toner to make communication state deteriorated can coincide with reference amount for judging whether or not amount of residual toner is acceptable for further image formation use.

As described in detail, similar to the first embodiment, the image forming apparatus 4 of the fourth embodiment realizes the developer cartridge and image forming apparatus surely capable of carrying out both residual-toner-amount detection and transmission of cartridge information with space saving design.

Fifth Embodiment

A fifth embodiment will be described in detail with reference to the accompanying drawings. A location of a storage unit with reference to a cartridge, structure around this item and a location of a communication unit with reference to an apparatus body are slightly different in comparison with the first embodiment. Accordingly, same numerals are assigned to portions common to the first and fifth embodiments and description on them will be omitted.

Figure 21:
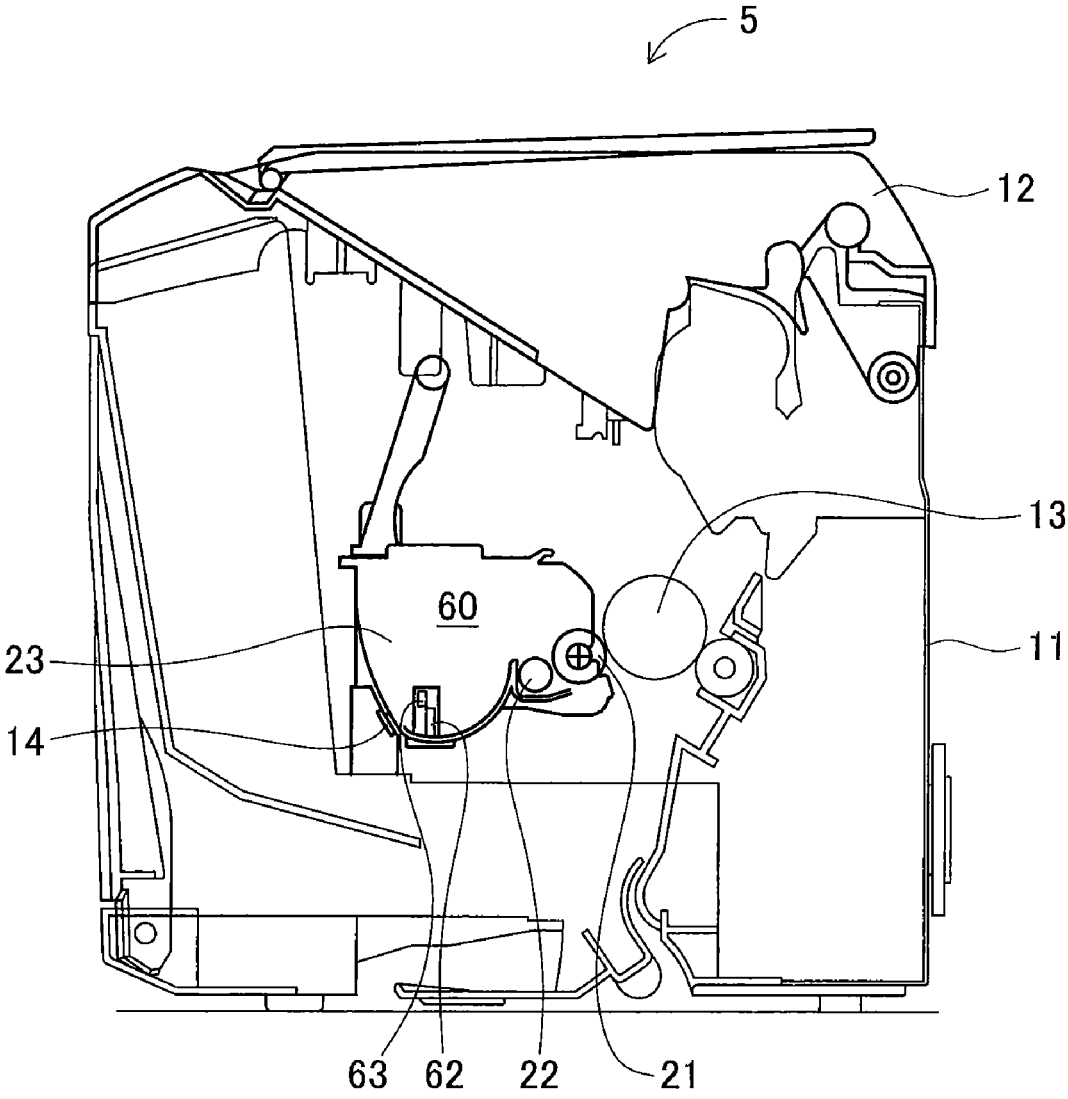
FIG. 21 is a cross sectional view of an image forming apparatus directed to a fifth embodiment.
Figure 22:
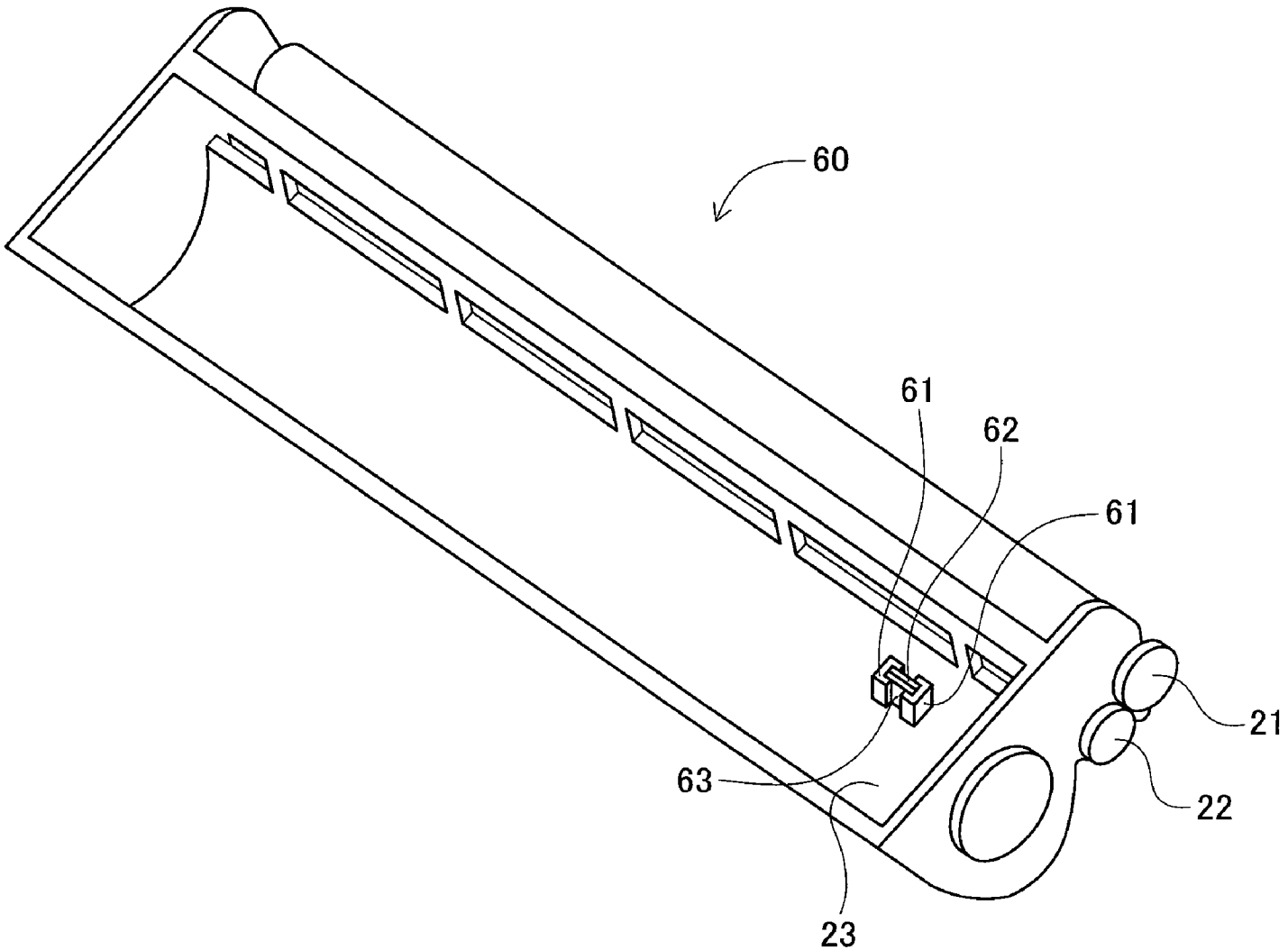
FIG. 22 is a cross sectional view of a cartridge directed to the fifth embodiment.

As shown in FIG. 21, an image forming apparatus 5 of the fifth embodiment comprises an apparatus body 11 and a cartridge 60. As shown in FIG. 22, on a bottom of a toner reservoir 23 in the cartridge 60, there is formed a storage unit holder 61. A storage unit 62 and a blocking member 63 are arranged together side by side inside the storage unit holder 61. The storage unit 62 is fixed to a bottom portion of the toner reservoir 23 with being held in the storage unit holder 61. A communication unit 14 of the apparatus body 11 is arranged on a location (a left portion of the cartridge 60 in FIG. 21) corresponding with the storage unit 62.

In this embodiment, the storage unit 62 has a front side and a back side. On the front side, plural (three in this embodiment) communication units 64 are provided. These communication units 64 take a role of communication function of the storage unit 62 and its communication goes forward in FIG. 23. Accordingly, in the present embodiment, the communication units 64 correspond to a cartridge-side communication unit and a front face of the storage unit 62 depicted in FIG. 23 corresponds to a communicable side of the storage unit 62. The blocking member 63 is arranged in front of the communicable side of the storage unit 62. Grooves are formed on inner faces of the storage unit holder 61 and left and right end portions of the blocking member 63 are fitted there, which enables the blocking member 63 to slide vertically within the storage unit holder 61 in FIG. 23. Furthermore, the blocking member 63 is made of material which floats on toner.

In this embodiment, non-magnetic type toner is used. Communication between the storage unit 62 and the communication unit 14 is made by means of electromagnetic wave. Therefore the communication can go without problem whether toner is present or absent between them. The blocking member 63 is made of material capable of blocking the communication. Therefore, in case the blocking member 63 is arranged in front of the respective communication units 64 of the storage unit 62, communication between the communication units 64 and the communication unit 14 of the apparatus body 11 is blocked.

Figure 23:
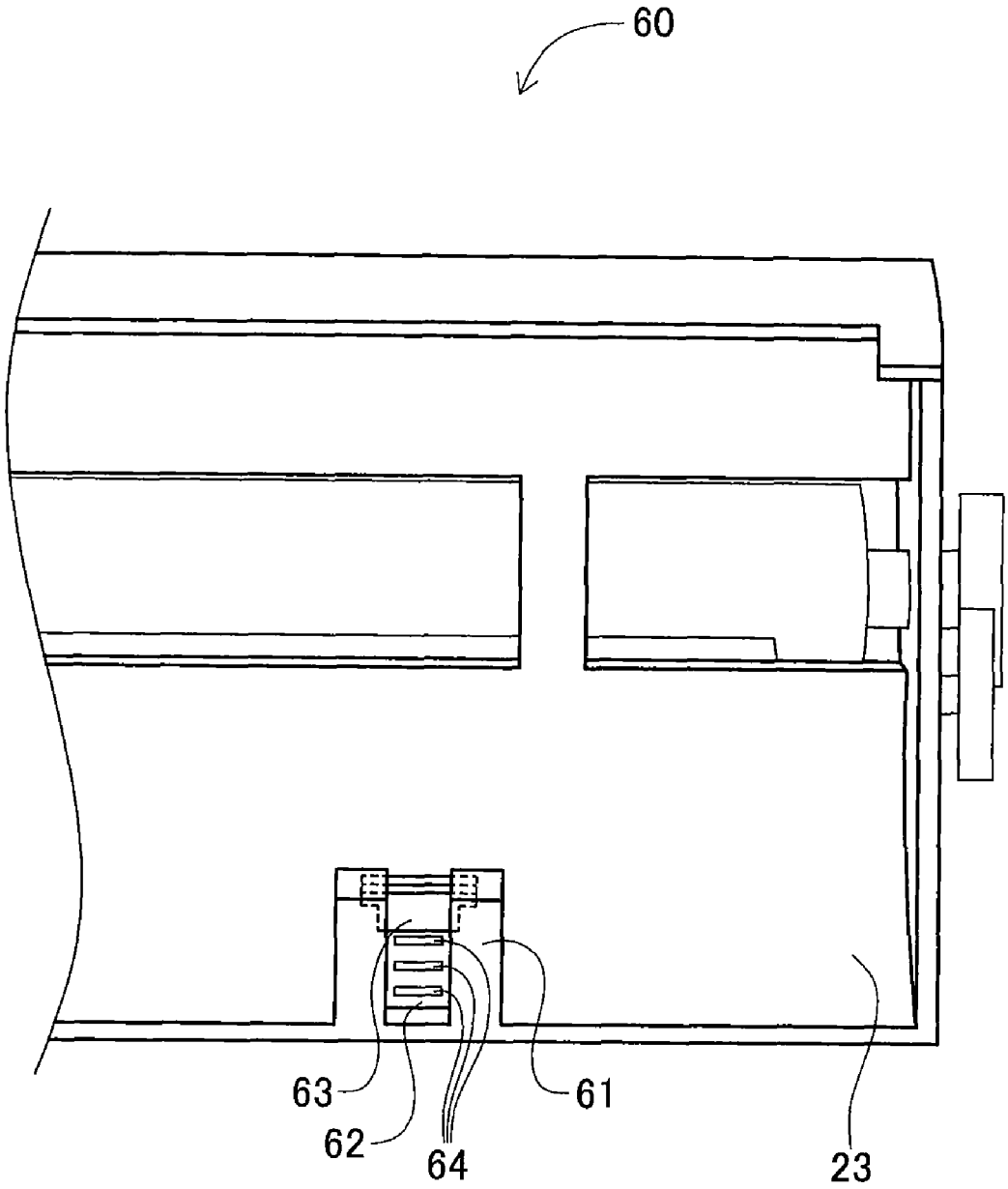
FIG. 23 is another cross sectional view of the cartridge directed to the fifth embodiment.
Figure 24:
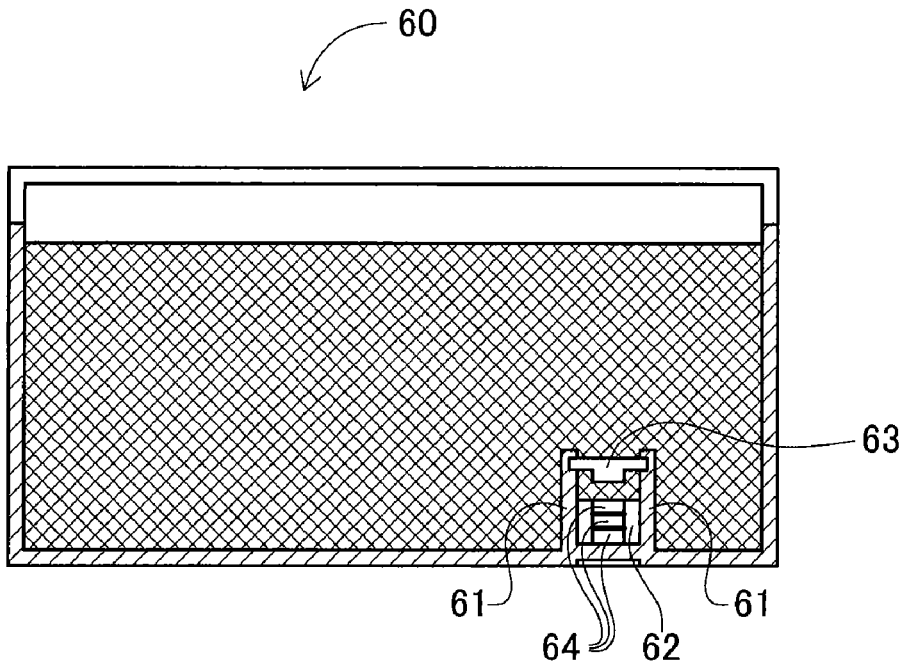
FIG. 24 is a diagram showing an inside state of the cartridge directed to the fifth embodiment which holds much toner.
Figure 25:
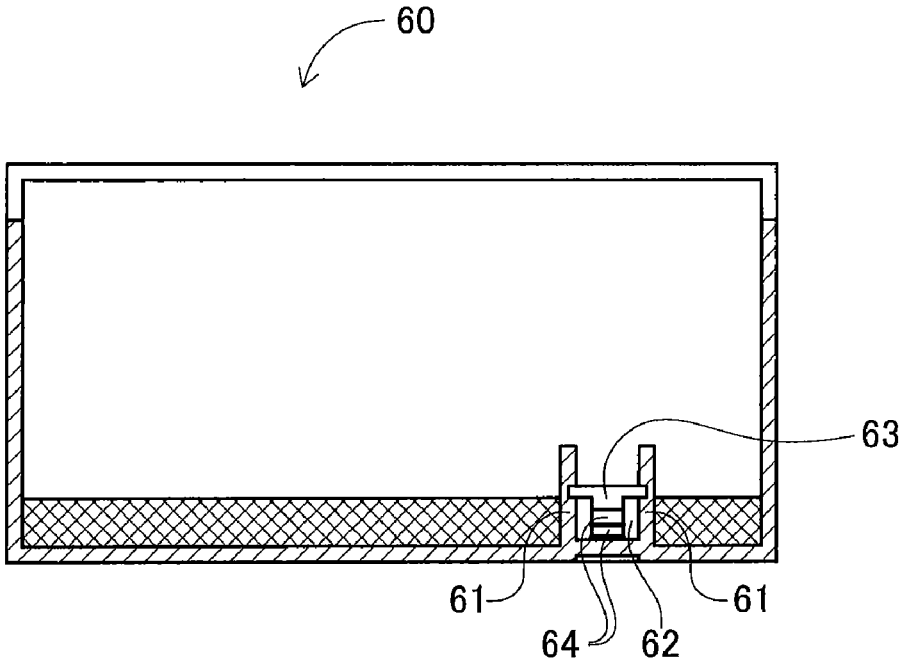
FIG. 25 is a diagram showing an inside state of the cartridge directed to the fifth embodiment which holds a little toner.

When the toner reservoir 23 holds sufficient toner, the blocking member 63 is held at a location to touch with a top end portion of the storage unit holder 61 as shown in FIG. 23 and FIG. 24. Therefore, none of the three communication units 64 is blocked by the blocking member 63. When the toner level in the toner reservoir 23 lowers than the top-end-portion level of the storage unit holder 61, the blocking member 63 comes down to a surface level of toner due to its own weight. Eventually, as shown in FIG. 25, the blocking member 63 blocks the front face of the communication units 64. In FIG. 25, the topmost communication unit 64 is blocked. Thereby, the communication state deteriorates. The location and size of the blocking member 63 is appropriately designed so that amount of residual toner to make communication state deteriorated can coincide with reference amount for judging whether or not amount of residual toner is acceptable for further image formation use.

In the course of manufacturing, the storage unit holder 61 is fixed to the bottom portion of the toner reservoir 23 with making the storage unit 62 and the blocking member 63 fitted in together. After that, by pouring toner into the toner reservoir 23 and shaking the toner reservoir 23 filled with toner a little, the blocking member 63 floats up due to its buoyant force.

As described in detail, similar to the first embodiment, the image forming apparatus 5 of the fifth embodiment realizes the developer cartridge and image forming apparatus surely capable of carrying out both residual-toner-amount detection and transmission of cartridge information with space saving design.

Sixth Embodiment

A sixth embodiment will be described in detail with reference to the accompanying drawings. A location of a storage unit with reference to a cartridge, structure around this item and a location of a communication unit with reference to an apparatus body are slightly different in comparison with the first embodiment. Accordingly, same numerals are assigned to portions common to the first and sixth embodiments and description on them will be omitted.

Figure 26:
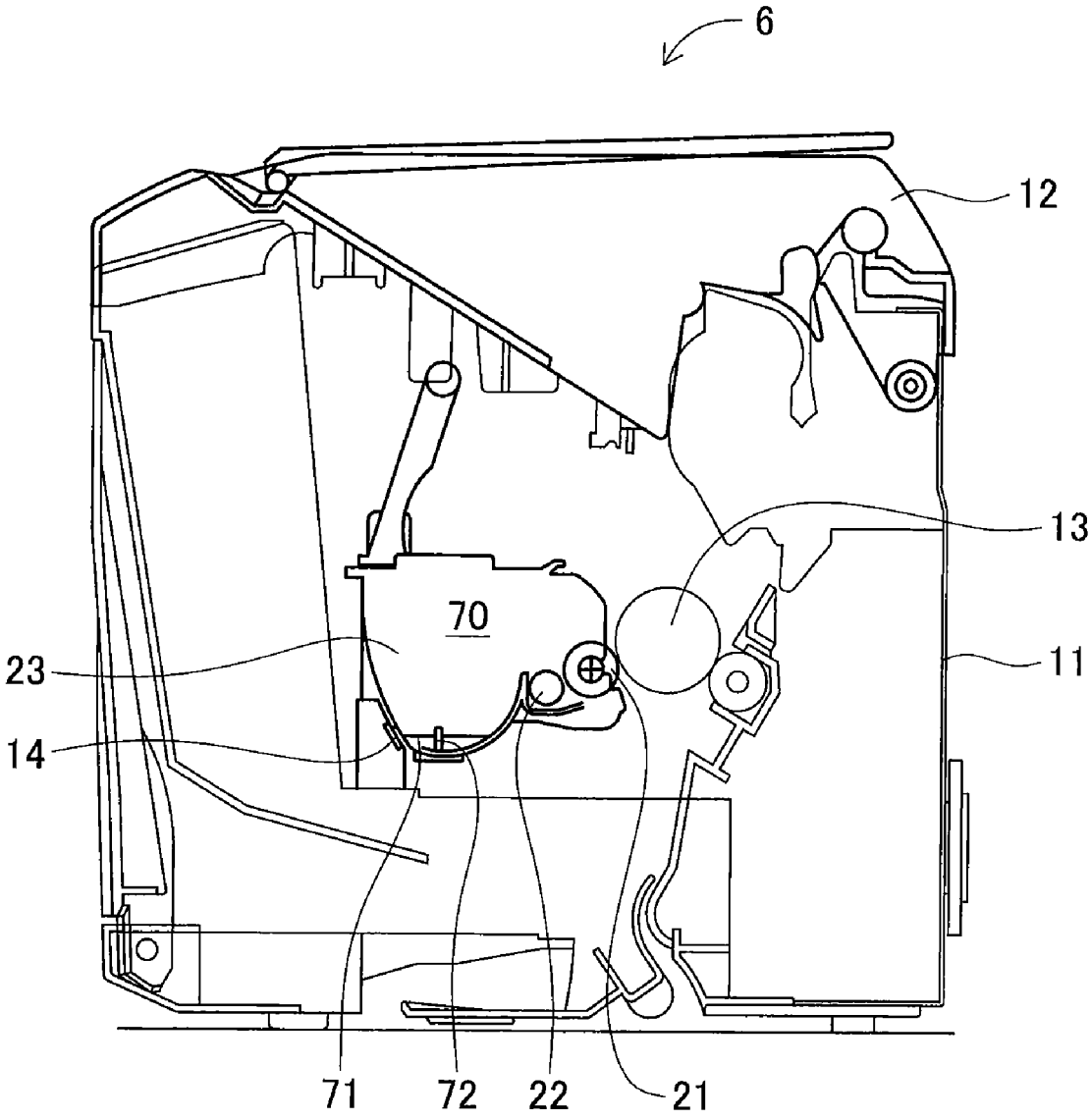
FIG. 26 is a cross sectional view of an image forming apparatus directed to a sixth embodiment.

As shown in FIG. 26, an image forming apparatus 6 of the sixth embodiment comprises an apparatus body 11 and a cartridge 70. In the present embodiment, a storage unit holder 71 and a storage unit 72 are fixed to a bottom portion of a toner reservoir 23 in the cartridge 70. A communication unit 14 of the apparatus body 11 is arranged on a location corresponding with the storage unit 72.

Figure 27:
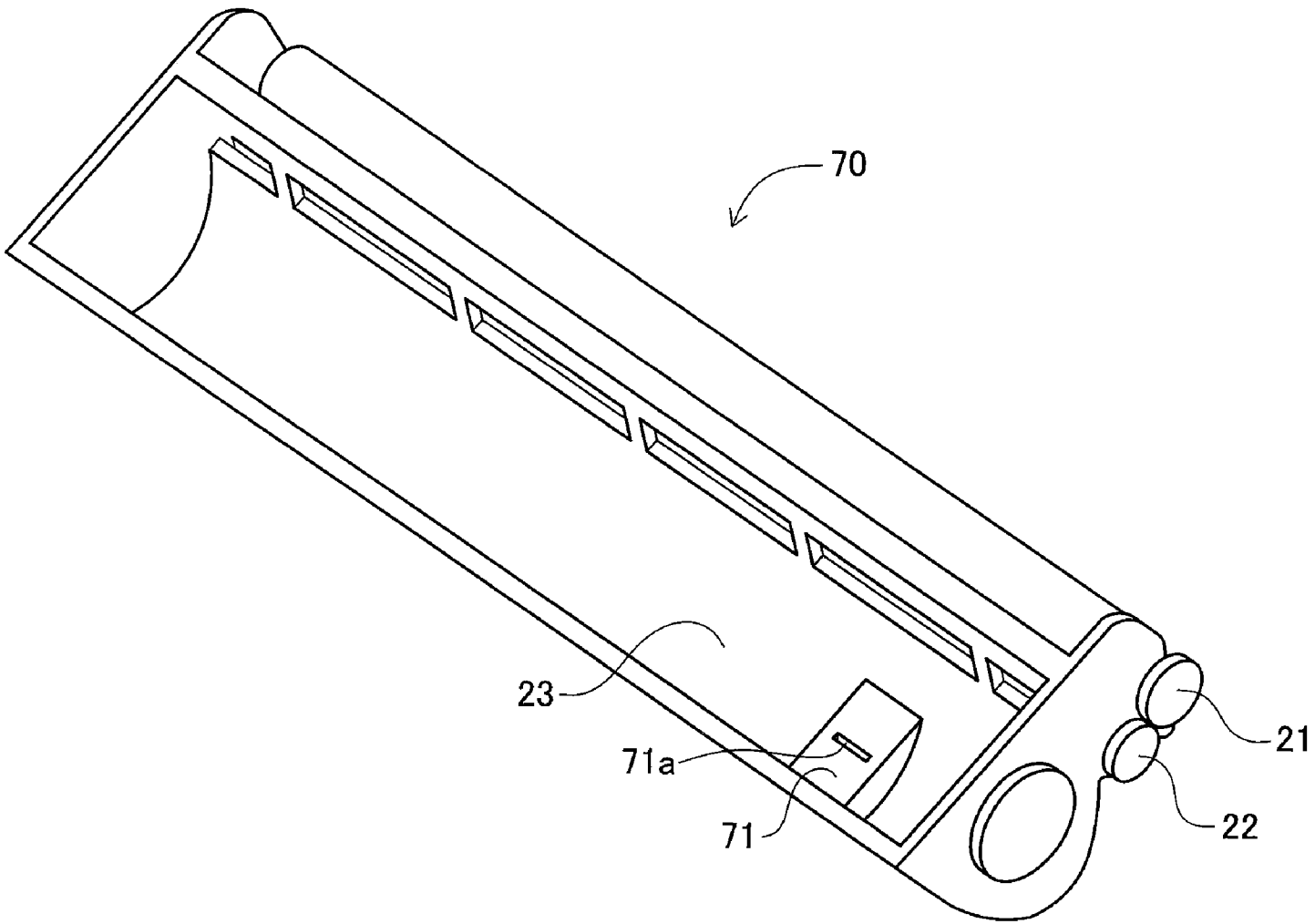
FIG. 27 is perspective view of a cartridge directed the sixth embodiment with its lid detached.
Figure 28:
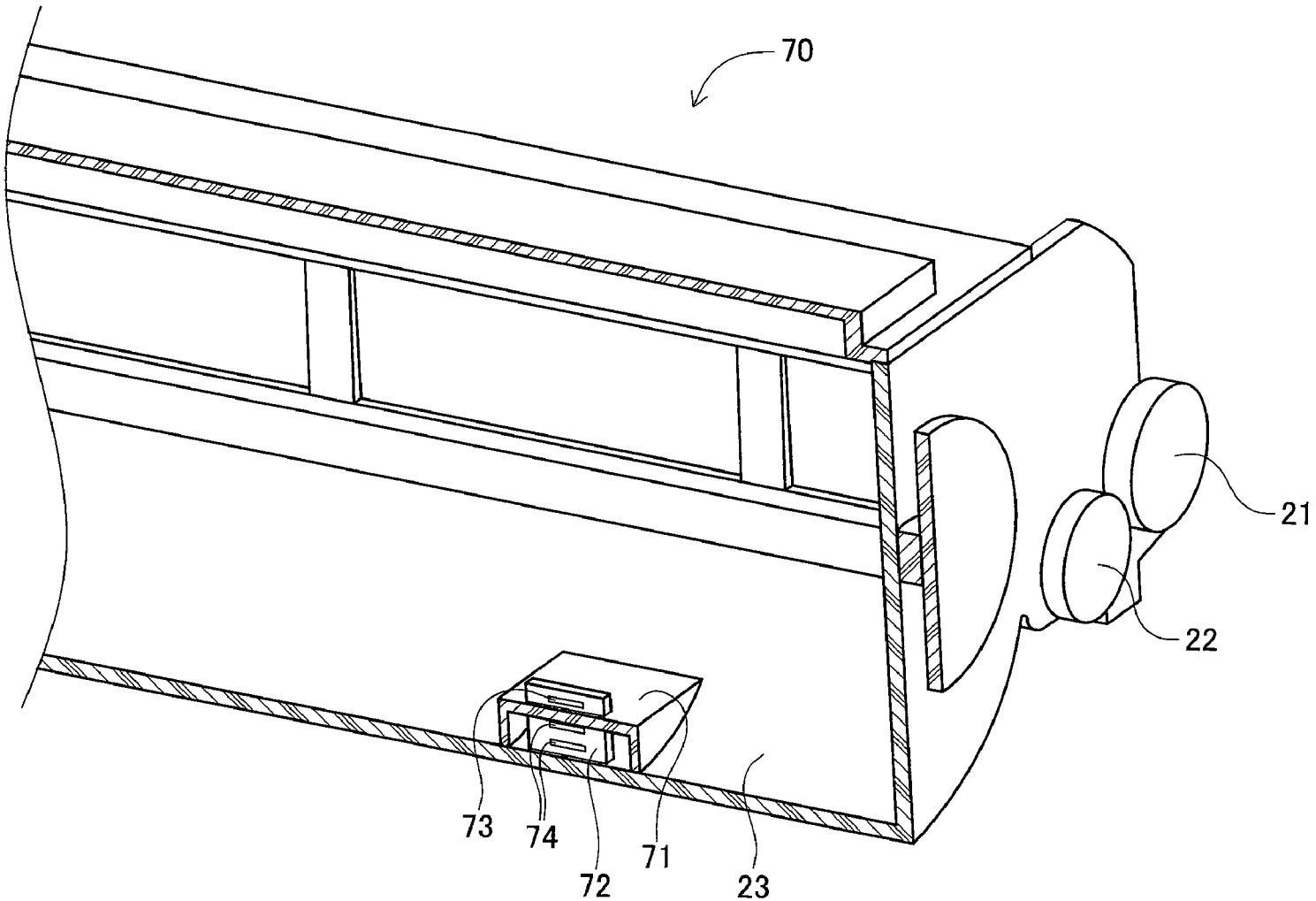
FIG. 28 is a cross sectional view of the cartridge directed to the sixth embodiment.

As shown in FIG. 27 and FIG. 28, there is formed the storage unit holder 71 in a form of covering a part of the bottom portion of the toner reservoir 23. On an upper face of the storage unit holder 71, a hole 71*a* is formed. The storage unit 72 penetrates through the hole 71*a* formed on the storage unit holder 71 and is fixed to the bottom portion of the toner reservoir 23. FIG. 27 is a perspective view of the toner cartridge 70 with its lid detached. FIG. 28 is a cross-sectional view of the cartridge 70 cut across a face in parallel with the axial direction. Actually, an agitating member such like as shown in FIG. 8 or the like for agitating toner is provided inside the toner reservoir 23.

When the storage unit 72 occupies the hole 71*a* of the storage unit holder 71, an inside space of the storage unit holder 71 is segregated from the toner reservoir 23. That is, toner cannot enter into a lower portion of the storage unit holder 71. Therefore, a two-third lower portion of the storage unit 72 shown in FIG. 28 is covered with the storage unit holder 71 and does not get contact with toner directly. On the other hand, a one-third upper portion of the storage unit 72 which pokes out upward from the storage unit holder 71 gets contact with toner directly.

As shown in FIG. 28, the present embodiment employs the storage unit 72 which has three communication units 73 and 74. The storage unit holder 71 holds the storage unit 72 with only the topmost communication unit 73 poking out upward. By setting the storage unit 72 in such a manner, the topmost communication unit 73 is covered with toner whereas the other communication units 74 are not covered with toner while there is sufficient toner. It is to be noted that magnetic type toner is used in the present embodiment.

Figure 29:
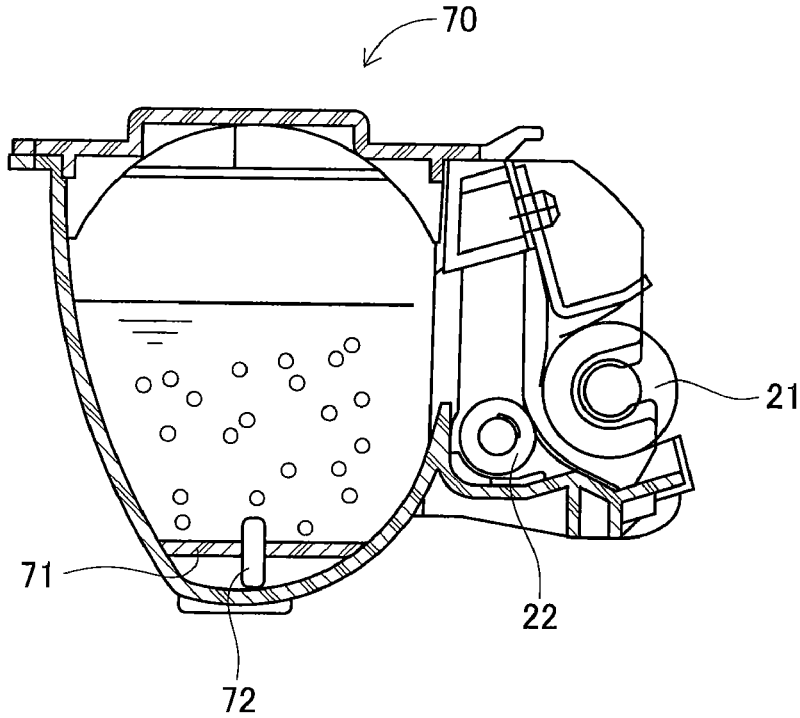
FIG. 29 is a diagram showing an inside state of the cartridge directed to the sixth embodiment which holds much toner.

When the toner reservoir 71 holds much toner as shown in FIG. 29, such structured storage unit 72 cannot communicate with the communication unit 73 normally because electromagnetic wave is shielded by carriers mixed with toner. On the other hand, the communication units 74 can communicate normally irrespective of amount of toner. Accordingly, at an initial state, the apparatus body 11 judges whether or not this cartridge is appropriate one by communicating with the communication units 74. That is, unique information is transmitted by the communication units 74 but not by the communication unit 73.

Figure 30:
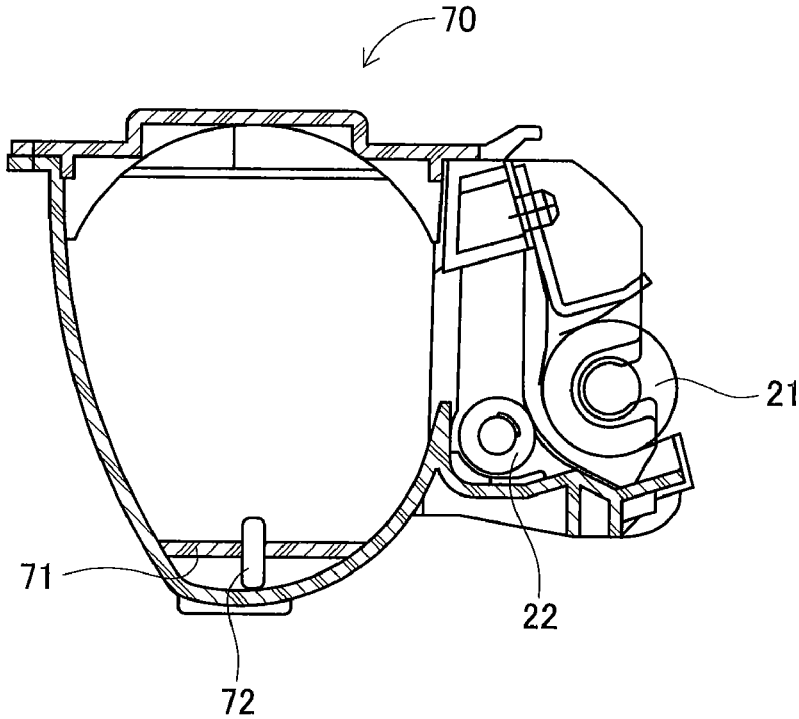
FIG. 30 is a diagram showing an inside state of the cartridge directed to the sixth embodiment which holds a little toner.

As amount of toner lessens in the course of accumulative use and the toner level in the toner reservoir 23 lowers than the height of the storage unit holder 71, both the communication unit 73 and the communication units 74 become free from shielding by carriers, as shown in FIG. 30. As a result, the communication unit 73 becomes communicable. That is, since the communication state changes, the apparatus body 11 can determine that amount of toner has decreased significantly. The location and size of the storage unit holder 71 is appropriately designed so that amount of residual toner to make communication state changed can coincide with reference amount for judging whether or not amount of residual toner is acceptable for further image formation use.

As described in detail, similar to the first embodiment, the image forming apparatus 6 of the sixth embodiment realizes the developer cartridge and image forming apparatus surely capable of carrying out both residual-toner-amount detection and transmission of cartridge information with space saving design. Incidentally, on assumption that communication frequency to be made use is within a visible light band, non-magnetic toner is also applicable.

Seventh Embodiment

A seventh embodiment will be described in detail with reference to the accompanying drawings. The seventh embodiment is applied to an image forming apparatus which employs a cover to be opened at an apparatus body's side, instead of a cover to be opened upward. Similar to the forgoing embodiments, same numerals are assigned to portions common to the first and seventh embodiments and description on them will be omitted.

Figure 31:
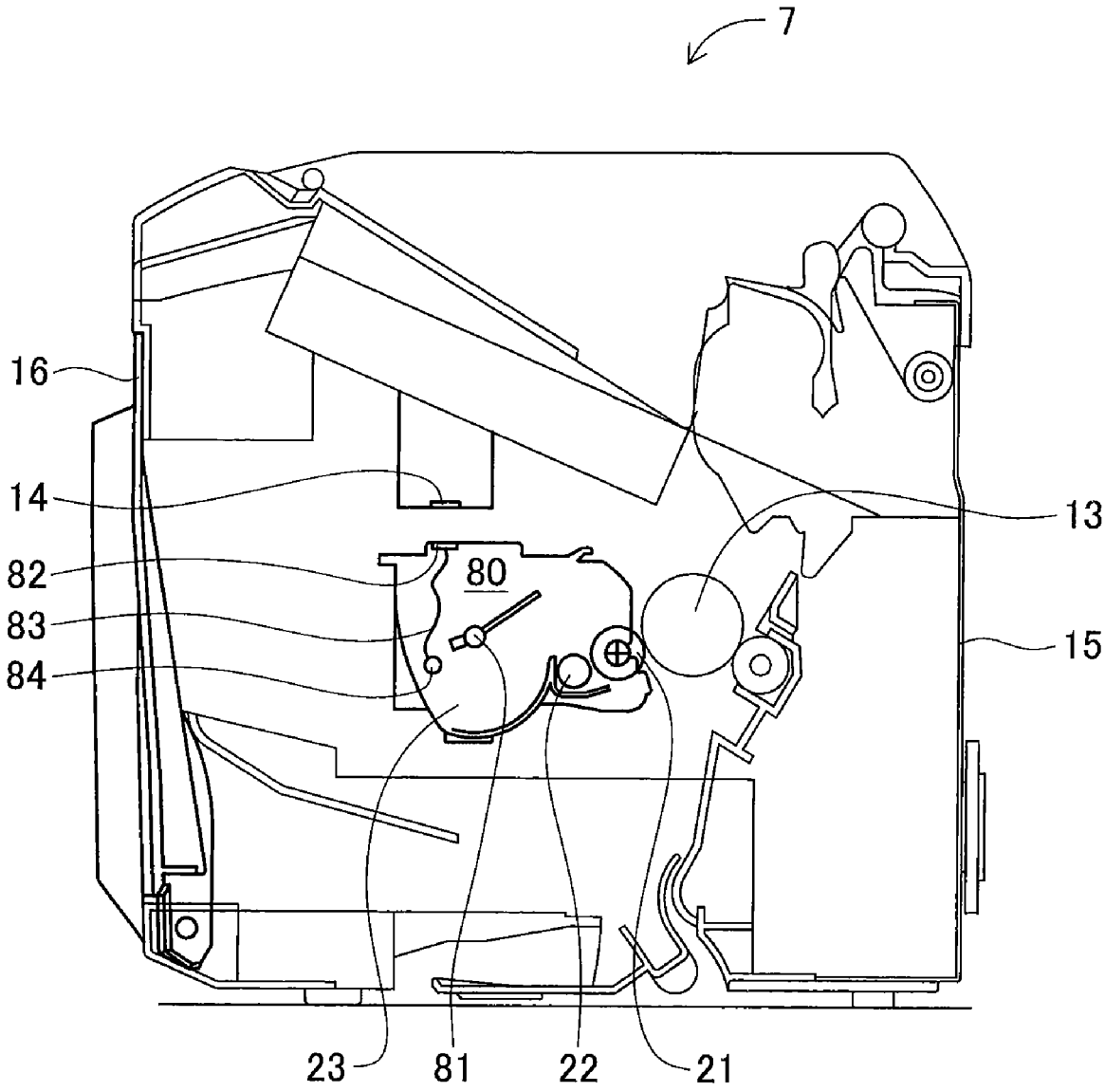
FIG. 31 is a cross sectional view of an image forming apparatus directed to a seventh embodiment.
Figure 32:
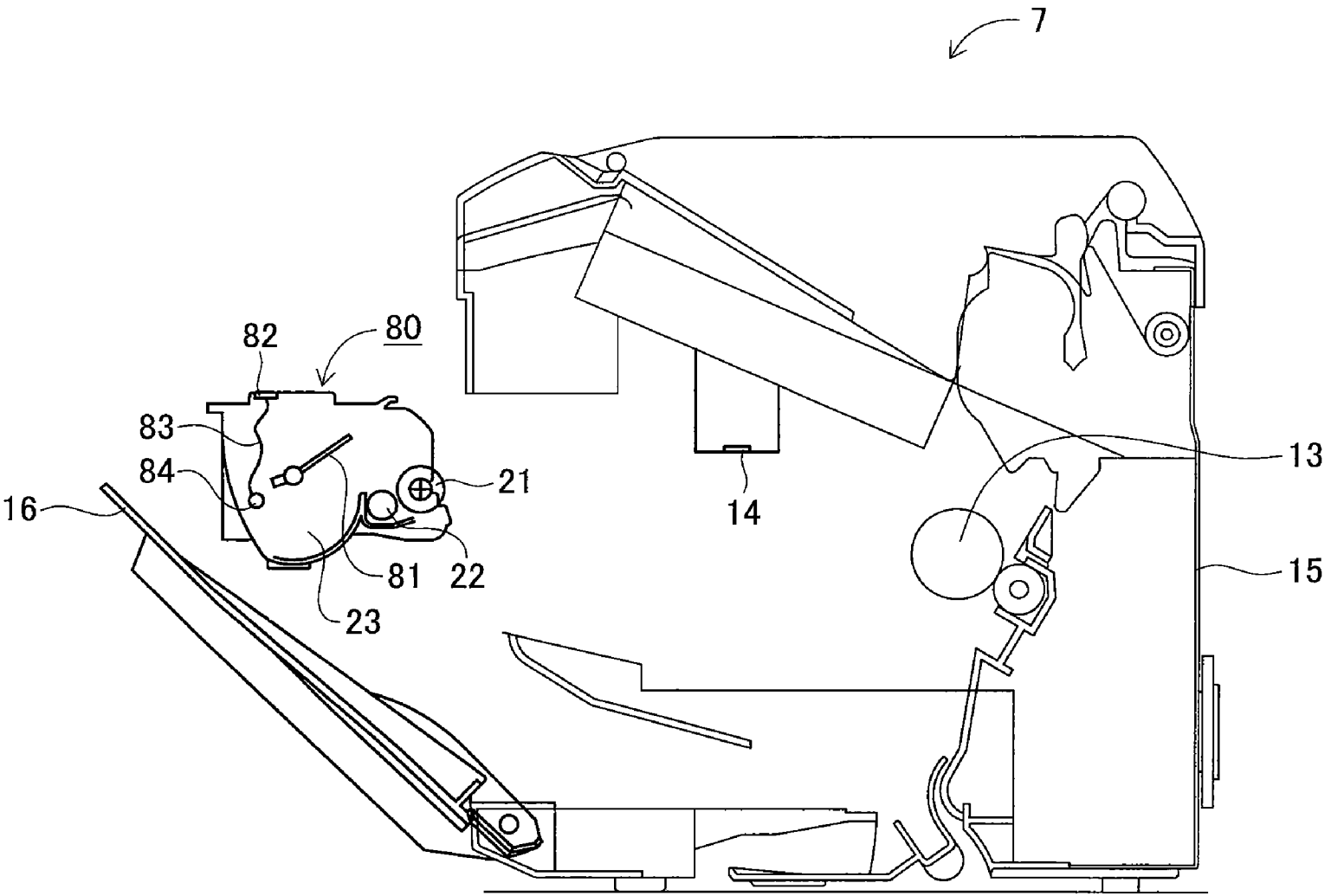
FIG. 32 is another cross sectional view of the image forming apparatus directed to the seventh embodiment.

As shown in FIG. 31, an image forming apparatus 7 of the seventh embodiment comprises an apparatus body 15 and a cartridge 80. The apparatus body 15 of the present embodiment comprises a cover 16 which is provided at a side face of the apparatus body 15 and opened downward as shown in FIG. 32. A cartridge 80 is attached to and detached from the cover-opened portion provided at the side face of the apparatus body 15. Inside a toner reservoir 23, the toner cartridge 80 comprises an agitating member 81, a storage unit 82, a flexible member 83, and a weight 84. The storage unit 82 is attached to a ceiling face of the toner reservoir 23. Furthermore, a communication unit 14 of the apparatus body 15 is arranged on a location (above of the cartridge 80 in FIG. 31) corresponding with the storage unit 82.

Figure 33:
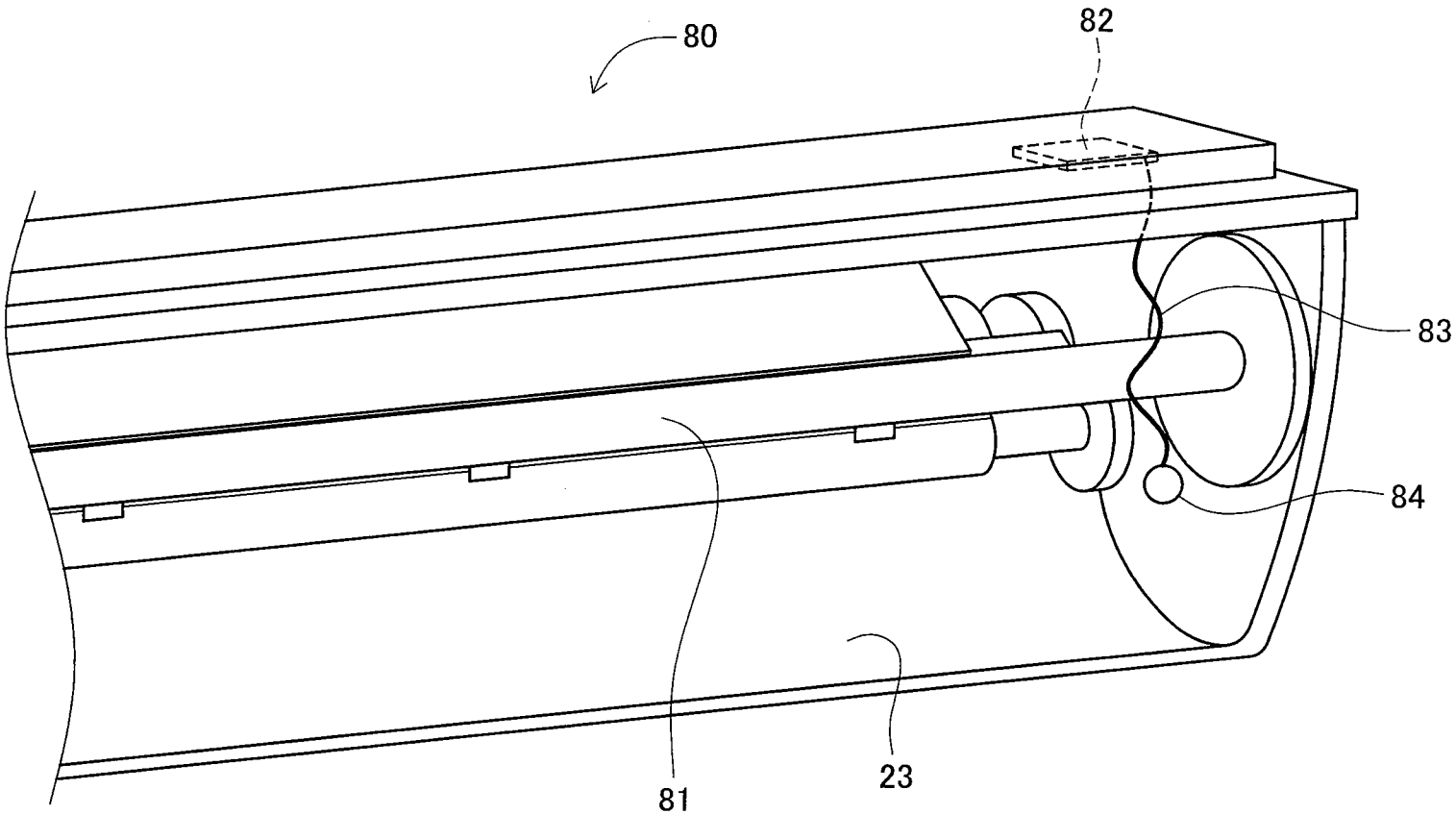
FIG. 33 is a cross sectional view of a cartridge directed to the seventh embodiment.

As shown in FIG. 33, the storage unit 82 of the cartridge 80 is attached to an inner upper portion of the toner reservoir 23. The storage unit 82 is lightly adhered there with double-faced adhesive or the like. Furthermore, one end of the flexible member 83 which is like a string is fixed to the storage unit 82. The other end of the flexible member 83 is fixed to the weight 84.

Figure 34:
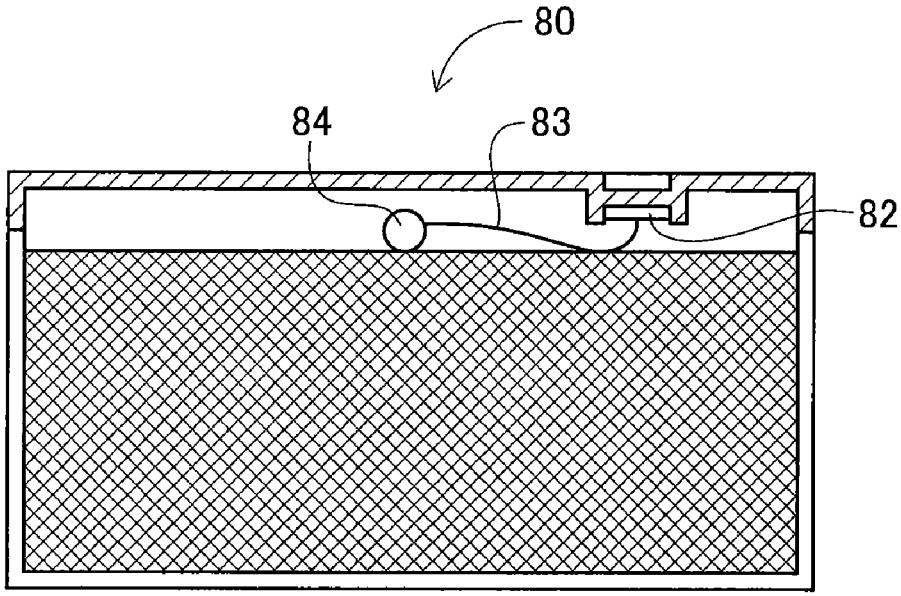
FIG. 34 is a diagram showing an inside state of the cartridge directed to the seventh embodiment which holds much toner.
Figure 35:
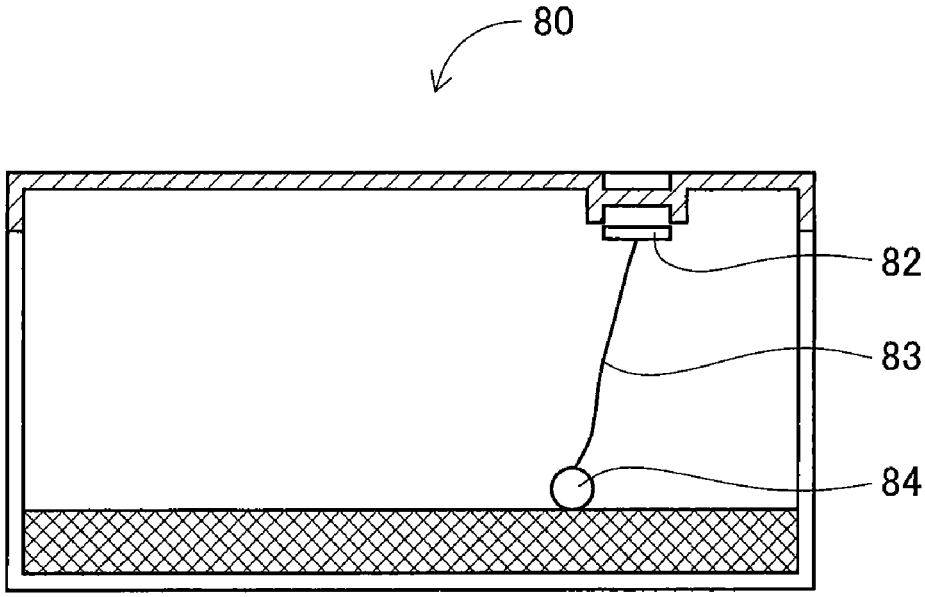
FIG. 35 is a diagram showing an inside state of the cartridge directed to the seventh embodiment which holds a little toner.

When the toner reservoir 23 of the cartridge 80 holds much toner, the weight 84 mounts on toner, as shown in FIG. 34. Or, the weight 84 sinking up to some extent of depth is supported by toner. Therefore, the flexible member 83 is deformed and weight of the weight 84 is not applied to the storage unit 82. As amount of toner decreases in the course of accumulative use, the weight 84 lowers downward due to its own weight, as shown in FIG. 35. As the toner level lowers than length of the flexible member 83, weight of the weight 84 is applied to the attached face of the storage unit 82 and the light adhesive eventually comes off.

Therefore, the storage unit 82 falls from the inner face of the toner reservoir 23. Since the storage unit 82 departs from the communication unit 14 of the apparatus body 15, the communication state deteriorates. This enables the apparatus body 15 to determine that amount of toner has decreased. The length of the flexible member 83 is appropriately set so that amount of residual toner to make communication state deteriorated can coincide with reference amount for judging whether or not amount of residual toner is acceptable for further image formation use.

As described in detail, similar to the first embodiment, the image forming apparatus 7 of the seventh embodiment realizes the developer cartridge and image forming apparatus surely capable of carrying out both residual-toner-amount detection and transmission of cartridge information with space saving design. Communication between the communication unit 14 and the storage unit 82 may go by wire. Furthermore, the present embodiment can employ a cover to be opened upward like the first through sixth embodiments. In case of employing such a cover, the communication unit 14 should be provided on the cover.

Eighth Embodiment

An eighth embodiment will be described in detail with reference to the accompanying drawings. Similar to the seventh embodiment, the eighth embodiment is applied to an image forming apparatus which employs a cover to be opened at an apparatus body's side. Same numerals are assigned to portions common to the seventh and eighth embodiments and description on them will be omitted.

Figure 36:
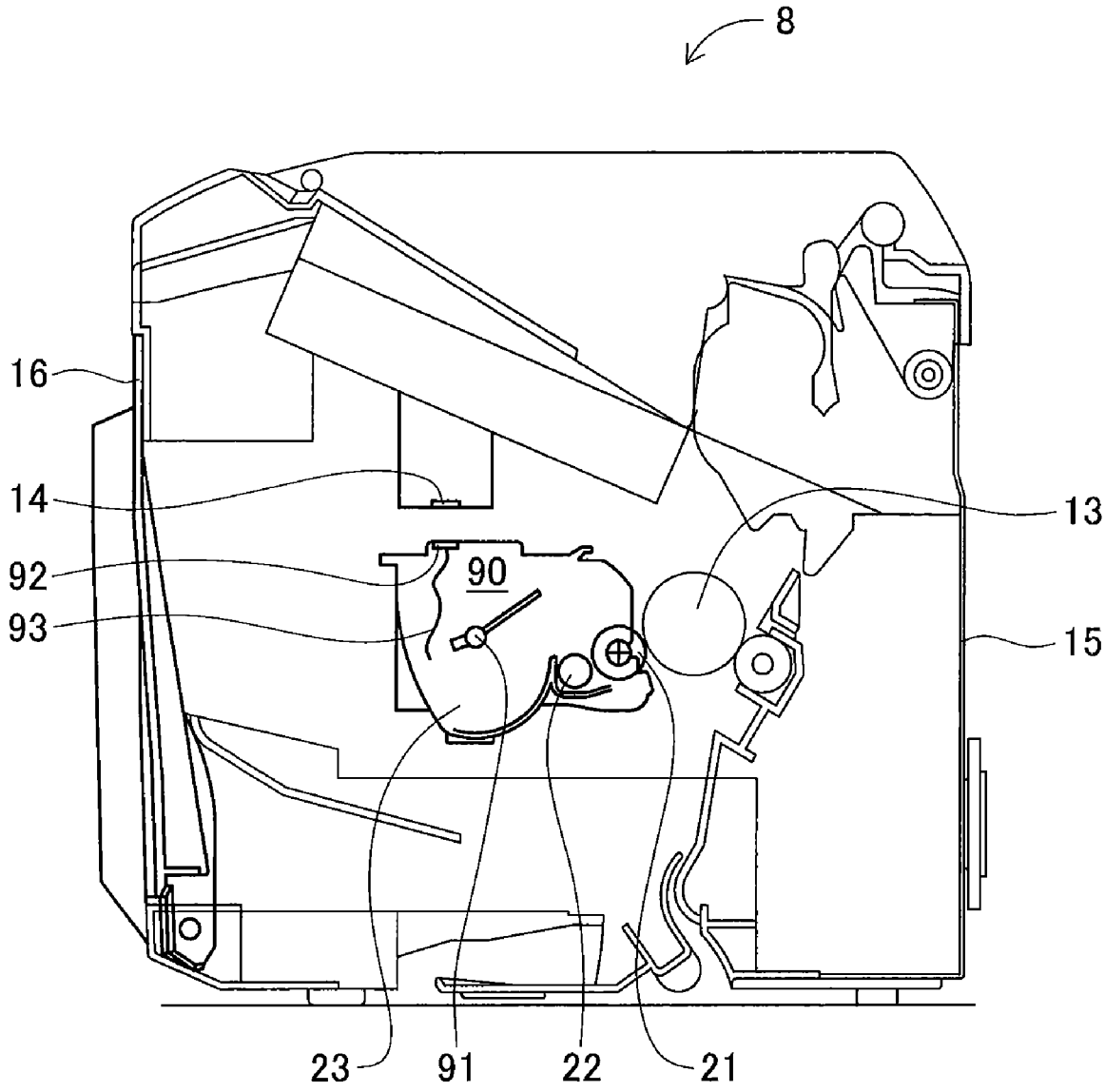
FIG. 36 is a cross sectional view of an image forming apparatus directed to an eighth embodiment.

As shown in FIG. 36, an image forming apparatus 8 of the eighth embodiment comprises an apparatus body 15 and a cartridge 90. Inside a toner reservoir 23, the toner cartridge 90 comprises an agitating member 91, a storage unit 92, and a string-like member 93. The storage unit 92 is attached to a ceiling face of the toner reservoir 23. Furthermore, a communication unit 14 of the apparatus body 15 is arranged on a location (above of the cartridge 80 in FIG. 36) corresponding with the storage unit 92.

Figure 37:
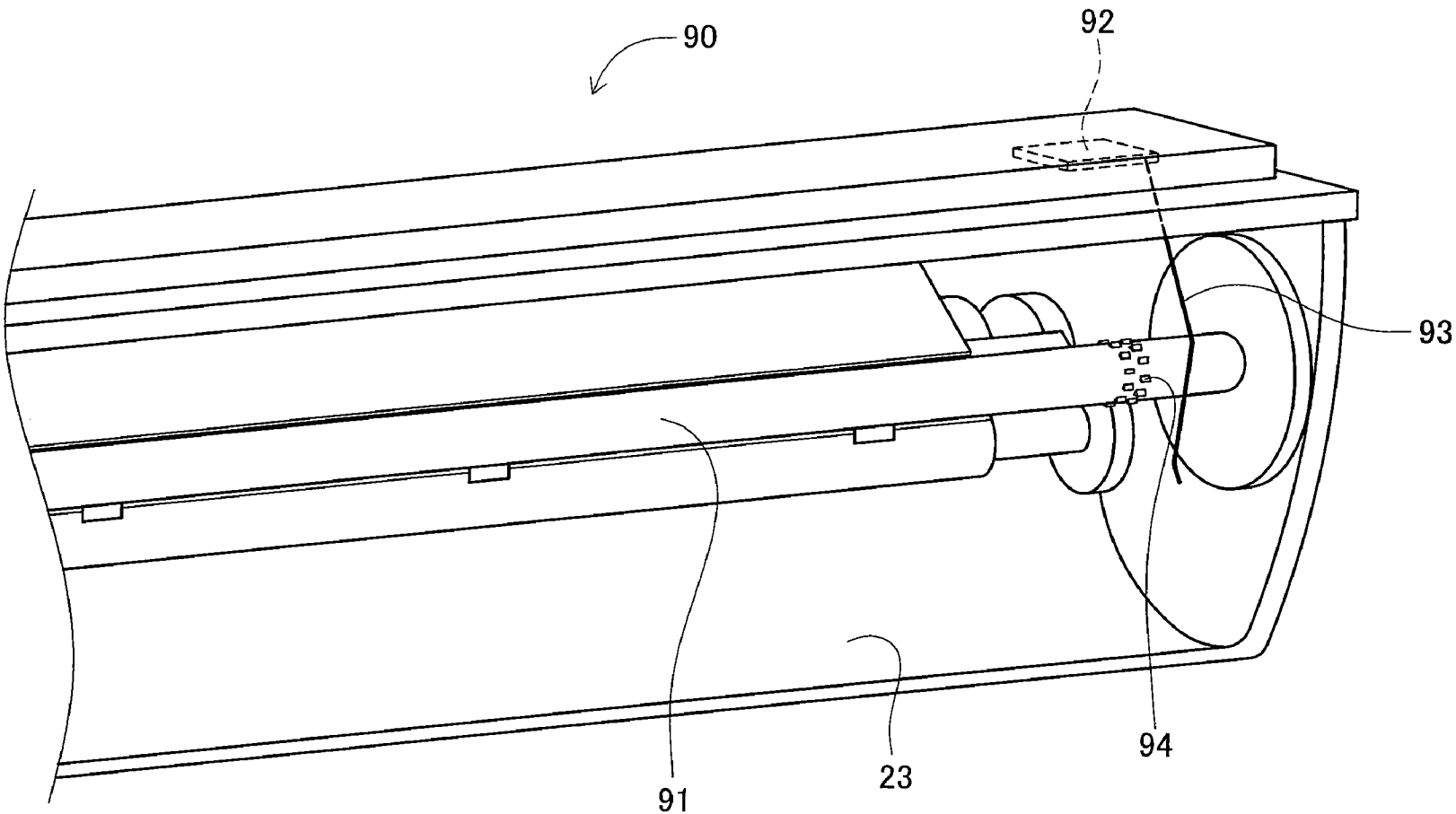
FIG. 37 is a cross sectional view of a cartridge directed to the eighth embodiment.

As shown in FIG. 37, the storage unit 92 of the cartridge 90 is attached to an inner upper portion of the toner reservoir 23. The storage unit 92 is lightly adhered there with double-faced adhesive or the like. Furthermore, one end of the string-like member 93 is fixed to the storage unit 92. Furthermore, at one end portion of a rotating shaft of the agitating member 91, there are formed plural protrusions 94 on the surface of the rotating shaft. Namely, protrusions 94 are formed at the side to which the storage unit 92 is provided, especially around a portion just below the storage unit 92.

Figure 38:
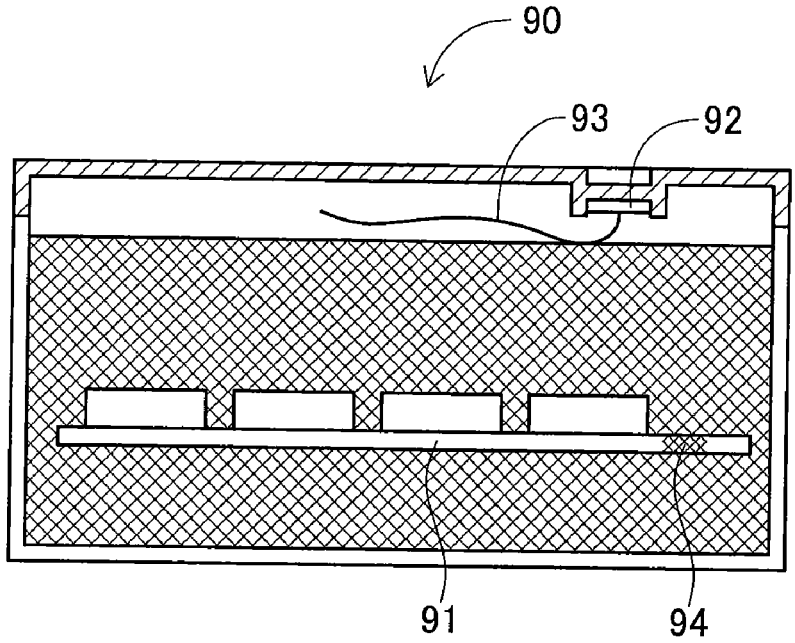
FIG. 38 is a diagram showing an inside state of the cartridge directed to the eighth embodiment which holds much toner.
Figure 39:
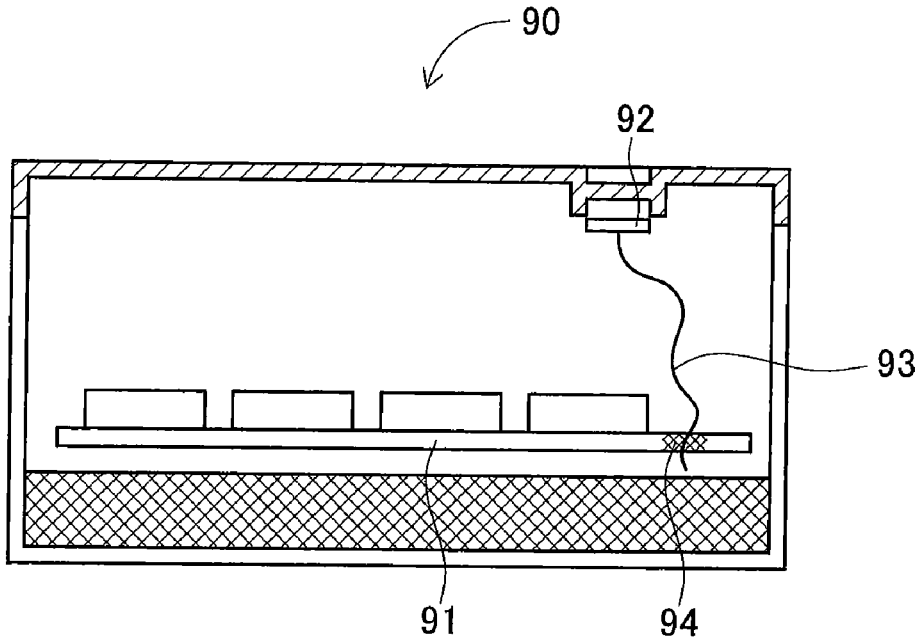
FIG. 39 is a diagram showing an inside state of the cartridge directed to the eighth embodiment which holds a little toner.

When the toner reservoir 23 of the cartridge 90 holds much toner, the string-like member 93 mounts on toner, as shown in FIG. 38. Accordingly, the string-like member 93 stays loose and any particular force is not applied to the storage unit 92. As amount of toner decreases in the course of accumulative use, the string-like member 93 hangs down as shown in FIG. 39. When a part of the string-like member 93 comes to contact with the protrusions 94 provided on the rotating shaft of the agitating member 91, the string-like member 93 and the protrusions 94 get entangled with each other. As the agitating member further rotates with this entangled state, the string-like member 93 is wound up into the rotating shaft.

As a result, the adhesive comes off and the storage unit 92 falls from the inner face of the toner reservoir 23. Since the storage unit 92 departs from the communication unit 14 of the apparatus body 15, the communication state deteriorates. This enables the apparatus body 15 to determine that amount of toner has decreased. Material of the string-like member 93 is appropriately set so that amount of residual toner to make communication state deteriorated can coincide with reference amount for judging whether or not amount of residual toner is acceptable for further image formation use.

As described in detail, similar to the first embodiment, the image forming apparatus 8 of the eighth embodiment realizes the developer cartridge and image forming apparatus surely capable of carrying out both residual-toner-amount detection and transmission of cartridge information with space saving design. Communication between the communication unit 14 and the storage unit 92 may go by wire. Furthermore, the present embodiment can employ a cover to be opened upward like the first through sixth embodiments. In case of employing such a cover, the communication unit 14 should be provided on the cover.

Figure 40:
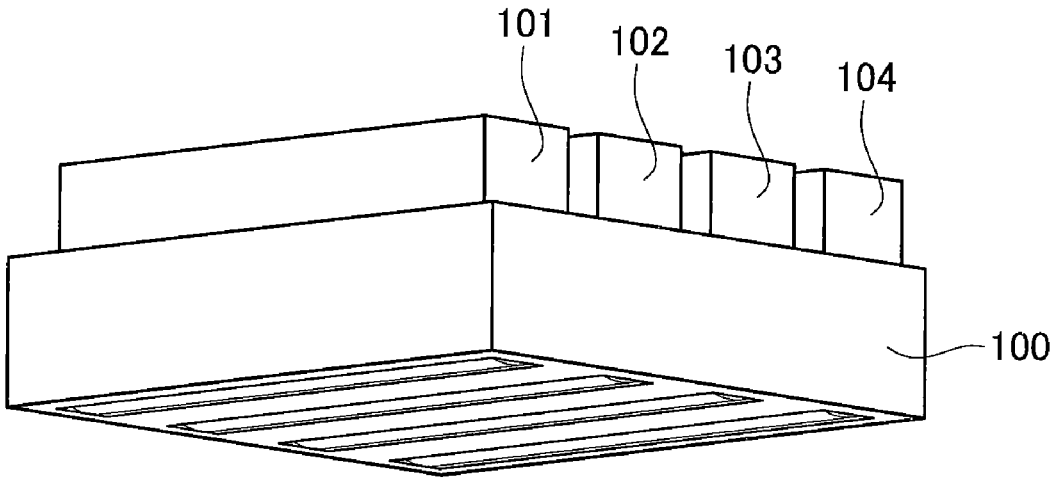
FIG. 40 is a perspective view of other example of a cartridge.
Figure 41:
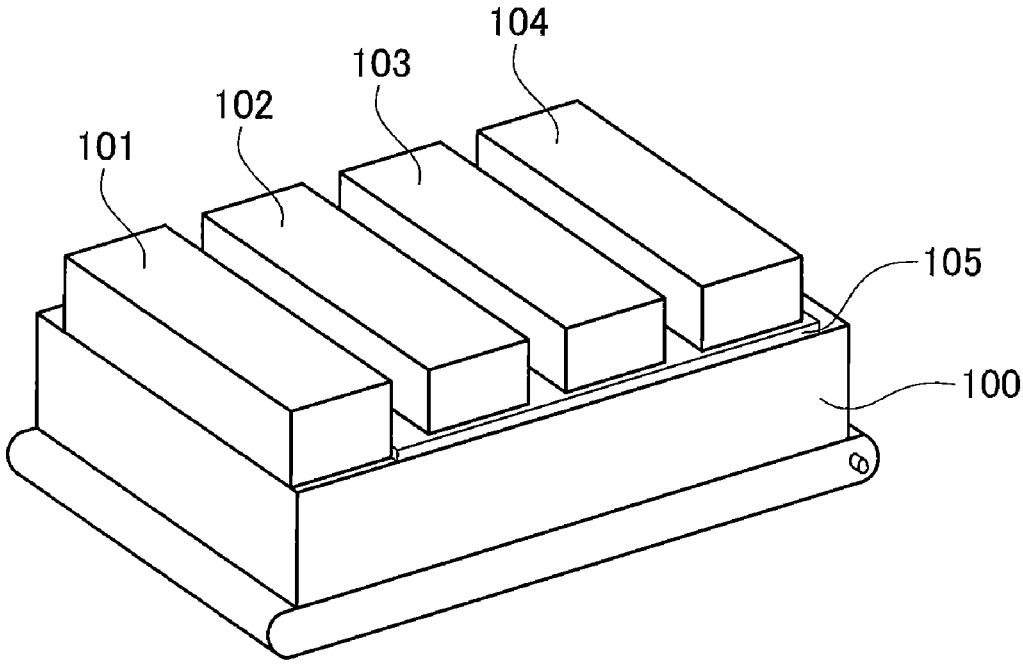
FIG. 41 is another perspective view of the other example of the cartridge.

The embodiments were described above merely as illustrative examples, but it is nothing to limit the invention in any way. Therefore, the invention can obviously be improved or modified in various ways without deviating from its essentials. For example, image forming apparatuses of any embodiments are single cartridge type. However, the present invention is applicable to an image forming apparatus to which plural cartridges are attached. For example, as shown in FIG. 40, the present invention is applicable to a complex cartridge constituted by combining and attaching four colors of cartridges 101, 102, 103, and 104 into a housing 100. Additionally, as shown in FIG. 41, the present invention is also applicable to another-type complex cartridge structured such that a single cartridge 101 and a housing 105 in which a complex of three cartridges 102, 103, and 104 are fitted are placed in a housing 100. Furthermore, the storage unit 62 of the fifth embodiment has plural communication units 64, however, the storage unit 62 may have a single communication unit which corresponds with reference amount for determining whether or not amount of residual toner is acceptable for further image formation use.

According to the present invention, it is preferable to provide an image forming apparatus wherein the cartridge-side communication unit stores unique information, and communication contents transmitted between the cartridge-side communication unit and the apparatus-side communication unit include stored unique information. Such configuration enables the image forming apparatus to easily detect erroneous attachment of a cartridge.

According to the present invention, it is preferable to provide an image forming apparatus wherein the developer cartridge further comprises: a rotating shaft which rotates in the developer container; and a bendable member which rotates together with the rotating shaft with one of sides being fixed to the rotating shaft, wherein the cartridge-side communication unit is placed on a location, inside the developer container, which enables the cartridge-side communication unit to get contact with the bendable member along rotation of the rotating shaft and to communicate with the apparatus-side communication unit while the developer cartridge is attached to the apparatus body, when developer in the developer container exceeds predetermined amount, the bendable member does not get contact with the cartridge-side communication unit due to intervention of developer and preferable communication state between the cartridge-side communication unit and the apparatus-side communication unit is secured, and when developer in the developer container lowers predetermined amount, the bendable member gets contact to move the cartridge-side communication unit and communication state deteriorates due to movement of the cartridge-side communication unit.

With such mechanism, preferable communication state between the communication unit and the image forming apparatus is secured when amount of developer in the developer container exceeds a predetermined reference amount. Therefore, when a cartridge is replaced with a new one, for example, erroneous attachment and the like can be detected. When amount of developer in the developer container lowers the predetermined reference amount, it makes communication state deteriorated. The deterioration of communication state can be easily grasped by the image forming apparatus. Therefore, such mechanism enables the image forming apparatus to easily detect amount of residual developer in the cartridge.

According to the present invention, it is preferable to provide an image forming apparatus wherein the developer cartridge further comprises: a development roller which carries out development by carrying developer thereon and rotating itself; and a supply roller which supplies developer to the development roller by rotating together with the rotating shaft, and wherein the bendable member is attached to a part other than an image formation region of the rotating shaft. Such structure contributes to space saving design without affecting image formation performance.

According to the present invention, it is preferable to provide an image forming apparatus wherein the developer cartridge further comprises an agitating member which rotates together with the rotating shaft and agitates developer in the developer container. With such structure, the bendable member and the agitating member can share the rotating shaft. Incidentally, the agitating member and the bendable member may be provided in separate forms or may be united into a single form.

According to the present invention, it is preferable to provide an image forming apparatus wherein the developer cartridge further comprises: a rotating shaft which rotates in the developer container; and a rocking member of which one end is attached to the rotating shaft slidably in rotating direction of the rotating shaft, wherein the cartridge-side communication unit is attached to other end of the rocking member, when amount of developer in the developer container exceeds a predetermined reference amount, the rocking member does not rock along rotation of the rotating shaft rotate due to intervention of developer and preferable communication state between the cartridge-side communication unit and the apparatus-side communication unit, and when amount of developer in the developer container lowers the predetermined reference amount, the rocking member rocks to move the cartridge-side communicating unit along rotation of the rotating shaft and communication state deteriorates due to movement of the cartridge-side communication unit. Such structure also enables the image forming apparatus to easily detect amount of residual developer in the cartridge.

According to the present invention, it is preferable to provide an image forming apparatus wherein the developer cartridge further comprises a communication unit holder which is attached inside the developer container with being open downward when the developer container is attached to an image forming apparatus, and holds the cartridge-side communication unit, when amount of developer in the developer container exceeds a predetermined reference amount, the cartridge-side communication unit is prevented from departing from the communication unit holder due to intervention of developer and preferable communication state with the apparatus-side communication unit is secured, and when amount of developer in the developer container lowers the predetermined reference amount, the cartridge-side communication unit falls to depart from the communication unit holder and communication state deteriorates. Such structure also enables the image forming apparatus to easily detect amount of residual developer in the cartridge.

According to the present invention, it is preferable to provide an image forming apparatus wherein the cartridge-side communication unit is arranged at a location which corresponds to a bottom portion inside the developer container when the developer container is attached to the apparatus body with its communicable side facing to the apparatus-side communication unit, the developer cartridge comprises: a blocking member which blocks communication between the cartridge-side communication unit and the apparatus-side communication unit; and a holder which holds the blocking member in front of the communicable side of the cartridge-side communication unit in a state which allows the blocking member to move up and down when the developer cartridge is attached to the apparatus body, developer in the developer container is non-magnetic type, when amount of developer in the developer container exceeds a predetermined reference amount, the blocking member is supported by developer at a location within a movable range provided inside the holder which does not allow the blocking member to block the communicable side of the cartridge-side communication unit and preferable communication state between the cartridge-side communication unit and the apparatus-side communication unit is secured, and when amount of developer in the developer container lowers the predetermined reference amount, the blocking member comes down from the location within the movable range provided inside the holder which does not allow the blocking member to block the communicable side of the cartridge-side communication unit to eventually block the communicable side of the cartridge-side communication unit and communication state deteriorates. Such structure also enables the image forming apparatus to easily detect amount of residual developer in the cartridge.

According to the present invention, it is preferable to provide an image forming apparatus wherein the developer cartridge further comprises: a holder which holds the cartridge-side communication unit at a location which corresponds to a bottom portion inside the developer container when the developer container is attached to the apparatus body with its communicable side facing to the apparatus-side communication unit, the holder segregates the communicable side of the cartridge-side communication unit into an upper communication section and a lower communication section, and prevents developer from entering around the lower communication section, developer in the developer container is magnetic type, when amount of developer in the developer container exceeds a predetermined reference amount, the upper communication section of the cartridge-side communication unit is covered with developer and communication with the apparatus-side communication unit is carried out by only the lower communication section, and when amount of developer in the developer container lowers the predetermined reference amount, the upper communication section appears out from developer and communication with the apparatus-side communication unit is carried out by the upper communication section. Such structure also enables the image forming apparatus to easily detect amount of residual developer in the cartridge.

According to the present invention, it is preferable to provide an image forming apparatus wherein the developer cartridge further comprises: a weight which is located inside the developer container; and a flexible member which connects the weight and the cartridge-side communication unit, wherein the cartridge-side communication unit is attached to a location which corresponds to a ceiling face inside the developer container when the developer container is attached to the apparatus body, when amount of developer in the developer container exceeds a predetermined reference amount, the weight is supported by developer and secures preferable communication state of the cartridge-side communication unit without applying the weight's own weight to the cartridge-side communication unit, and when amount of developer in the developer container lowers the predetermined reference amount, the weight removes the cartridge-side communication unit from an inner face of the developer container by applying the weight's own weight to the cartridge-side communication unit through the flexible member and communication state deteriorates. Such structure also enables the image forming apparatus to easily detect amount of residual developer in the cartridge.

According to the present invention, it is preferable to provide an image forming apparatus wherein the cartridge-side communication unit is attached to a location which corresponds to a ceiling face inside the developer container when the developer container is attached to the apparatus body, the developer cartridge further comprises: a string-like member which is connected to the cartridge-side communication unit; a rotating shaft which rotates within the developer container and comprises protrusions which catch and wind up the string-like member entangled with the rotating shaft along rotation, when amount of developer in the developer container exceeds a predetermined reference amount, the protrusions are buried in developer and secures preferable communication state of the cartridge-side communication unit without catching and winding up the string-like member, and when amount of developer in the developer container lowers the predetermined reference amount, the protrusions appear from developer and remove the cartridge-side communication unit from an inner face of the developer container by catching and winding up the string-like member along rotation of the rotating shaft, and communication state deteriorates. Such structure also enables the image forming apparatus to easily detect amount of residual developer in the cartridge.

What is claimed is:

1. A developer cartridge comprising:

a developer container, wherein the developer cartridge, when attached to an image forming apparatus for use, supplies a developer in the developer container to the image forming apparatus for development;

a communication unit provided inside the developer container and capable of communicating with the image forming apparatus, wherein a communication state between the communication unit and the image forming apparatus varies depending on an amount of the developer in the developer container;

a rotating shaft which rotates in the developer container; and a bendable member which rotates together with the rotating shaft with one side being fixed to the rotating shaft, wherein the communication unit is placed in a location, inside the developer container, which enables the communication unit to get in contact with the bendable member along the rotation of the rotating shaft and to communicate with the image forming apparatus while the developer cartridge is attached to the image forming apparatus, when the amount of the developer in the developer container exceeds a predetermined amount, the bendable member does not get in contact with the communication unit due to intervention of the developer and a preferable communication state of the communication unit is secured, and when the amount of developer in the developer container is lower than the predetermined amount, the bendable member gets in contact to move the communication unit and the communication state deteriorates due to the movement of the communication unit.

2. The developer cartridge according to claim 1 further comprising:

a development roller which carries out development by carrying the developer thereon and rotating itself; and a supply roller which supplies the developer to the development roller by rotating together with the rotating shaft, wherein the bendable member is attached to a part other than an image formation region of the rotating shaft.

3. The developer cartridge according to claim 1 further comprising an agitating member which rotates together with the rotating shaft and agitates the developer in the developer container.

4. A developer cartridge comprising:

a developer container, wherein the developer cartridge, when attached to an image forming apparatus for use, supplies a developer in the developer container to the image forming apparatus for development;

a communication unit provided inside the developer container and capable of communicating with the image forming apparatus, wherein a communication state between the communication unit and the image forming apparatus varies depending on an amount of the developer in the developer container;

a rotating shaft which rotates in the developer container; and a rocking member of which one end is attached to the rotating shaft slidably in a rotating direction of the rotating shaft, wherein the communication unit is attached to the other end of the rocking member, when the amount of the developer in the developer container exceeds a predetermined reference amount, the rocking member does not rock along rotation of the rotating shaft due to intervention of the developer and a preferable communication state of the communication unit is secured, and when the amount of the developer in the developer container is lower than the predetermined reference amount, the rocking member rocks to move the communication unit along a rotation of the rotating shaft and the communication state deteriorates due to movement of the communication unit.

5. A developer cartridge comprising:

a developer container, wherein the developer cartridge, when attached to an image forming apparatus for use, supplies a developer in the developer container to the image forming apparatus for development;

a communication unit provided inside the developer container and capable of communicating with the image forming apparatus, wherein a communication state between the communication unit and the image forming apparatus varies depending on an amount of the developer in the developer container; and a communication unit holder which is attached inside the developer container while being open downward when the developer container is attached to the image forming apparatus, and holds the communication unit, wherein when the amount of the developer in the developer container exceeds a predetermined reference amount, the communication unit is prevented from departing from the communication unit holder due to intervention of the developer and a preferable communication state is secured, and when the amount of the developer in the developer container is lower than the predetermined reference amount, the communication unit falls to depart from the communication unit holder and the communication state deteriorates.

6. A developer cartridge comprising:

a developer container, wherein the developer cartridge, when attached to an image forming apparatus for use, supplies a developer in the developer container to the image forming apparatus for development;

a communication unit provided inside the developer container and capable of communicating with the image forming apparatus, wherein a communication state between the communication unit and the image forming apparatus varies depending on an amount of the developer in the developer container, and the communication unit is arranged at a location which corresponds to a bottom portion inside the developer container when the developer container is attached to the image forming apparatus with its communicable side facing a communication unit of the image forming apparatus;

a blocking member which blocks communication between the communication unit and the image forming apparatus; and a holder which holds the blocking member in front of the communicable side of the communication unit in a state which allows the blocking member to move up and down when the developer cartridge is attached to the image forming apparatus, wherein the developer in the developer container is non-magnetic, when the amount of the developer in the developer container exceeds a predetermined reference amount, the blocking member is supported by the developer at a location within a movable range provided inside the holder which does not allow the blocking member to block the communicable side of the communication unit and a preferable communication state at the communication unit is secured, and when the amount of the developer in the developer container is lower than the predetermined reference amount, the blocking member comes down from the location within the movable range provided inside the holder, which does not allow the blocking member to block the communicable side of the communication unit to eventually block the communicable side of the communication unit, and the communication state deteriorates.

7. A developer cartridge comprising:

a developer container, wherein the developer cartridge, when attached to an image forming apparatus for use, supplies a developer in the developer container to the image forming apparatus for development;

a communication unit provided inside the developer container and capable of communicating with the image forming apparatus, wherein a communication state between the communication unit and the image forming apparatus varies depending on an amount of the developer in the developer container; and a holder which holds the communication unit at a location which corresponds to a bottom portion inside the developer container when the developer container is attached to the image forming apparatus with its communicable side facing a communication unit of the image forming apparatus, wherein the holder segregates the communicable side of the communication unit into an upper communication section and a lower communication section, and prevents the developer from entering around the lower communication section, the developer in the developer container is magnetic, when the amount of the developer in the developer container exceeds a predetermined reference amount, the upper communication section of the communication unit is covered with the developer and communication with the image forming apparatus is carried out by only the lower communication section, and when the amount of the developer in the developer container is lower than the predetermined reference amount, the upper communication section appears out from the developer and the communication with the image forming apparatus is carried out by the upper communication section.

8. A developer cartridge comprising:

a developer container, wherein the developer cartridge, when attached to an image forming apparatus for use, supplies a developer in the developer container to the image forming apparatus for development;

a communication unit provided inside the developer container and capable of communicating with the image forming apparatus, wherein a communication state between the communication unit and the image forming apparatus varies depending on an amount of the developer in the developer container;

a weight which is located inside the developer container; and a flexible member which connects the weight and the communication unit, wherein the communication unit is attached to a location which corresponds to a ceiling face inside the developer container when the developer container is attached to the image forming apparatus, when the amount of the developer in the developer container exceeds a predetermined reference amount, the weight is supported by the developer and secures a preferable communication state of the communication unit without applying the weight's own weight to the communication unit, and when the amount of the developer in the developer container is lower than the predetermined reference amount, the weight removes the communication unit from an inner face of the developer container by applying the weight's own weight to the communication unit though the flexible member and the communication state deteriorates.

9. A developer cartridge comprising:

a developer container, wherein the developer cartridge, when attached to an image forming apparatus for use, supplies a developer in the developer container to the image forming apparatus for development;

a communication unit provided inside the developer container and capable of communicating with the image forming apparatus, wherein a communication state between the communication unit and the image forming apparatus varies depending on an amount of the developer in the developer container, and the communication unit is attached to a location which corresponds to a ceiling face inside the developer container when the developer container is attached to the image forming apparatus;

a string-like member which is connected to the communication unit;

a rotating shaft which rotates within the developer container and comprises protrusions which catch and wind up the string-like member entangled with the rotating shaft along rotation, wherein when the amount of the developer in the developer container exceeds a predetermined reference amount, the protrusions are buried in the developer and secures a preferable communication state of the communication unit without catching and winding up the string-like member, and when the amount of the developer in the developer container is lower than the predetermined reference amount, the protrusions appear from the developer and remove the communication unit from an inner face of the developer container by catching and winding up the string-like member along rotation of the rotating shaft, and the communication state deteriorates.

10. An image forming apparatus, comprising a developer cartridge equipped with a developer container, and an apparatus body, the image forming apparatus being used with the developer cartridge attached thereto to supply a developer in the developer container for development, wherein the developer cartridge comprises a cartridge-side communication unit which is provided inside the developer container and capable of communicating with the apparatus body, the apparatus body comprises an apparatus-side communication unit which is capable of communicate with the cartridge-side communication unit, and a communication state between the cartridge-side communication unit and the apparatus-side communication unit varies depending on an amount of the developer in the developer container, wherein the developer cartridge further comprises:

a rotating shaft which rotates in the developer container; and a bendable member which rotates together with the rotating shaft with one side being fixed to the rotating shaft, wherein the cartridge-side communication unit is placed in a location inside the developer container, which enables the cartridge-side communication unit to get in contact with the bendable member along the rotation of the rotating shaft and to communicate with the apparatus-side communication unit while the developer cartridge is attached to the apparatus body, when the amount of the developer in the developer container exceeds a predetermined amount, the bendable member does not get in contact with the cartridge-side communication unit due to intervention of the developer and a preferable communication state between the cartridge-side communication unit and the apparatus-side communication unit is secured, and when the amount of the developer in the developer container is lower than the predetermined amount, the bendable member gets in contact to move the cartridge-side communication unit and the communication state deteriorates due to the movement of the cartridge-side communication unit.

11. The image forming apparatus according to claim 10, wherein the developer cartridge further comprises:

a development roller which carries out development by carrying the developer thereon and rotating itself; and a supply roller which supplies the developer to the development roller by rotating together with the rotating shaft, wherein the bendable member is attached to a part other than an image formation region of the rotating shaft.

12. The image forming apparatus according to claim 10, wherein the developer cartridge further comprises an agitating member which rotates together with the rotating shaft and agitates the developer in the developer container.

13. A image forming apparatus comprising a developer cartridge equipped with a developer container, and an apparatus body, the image forming apparatus being used with the developer cartridge attached thereto to supply a developer in the developer container for development, wherein the developer cartridge comprises a cartridge-side communication unit which is provided inside the developer container and capable of communicating with the apparatus body, the apparatus body comprises an apparatus-side communication unit which is capable of communicate with the cartridge-side communication unit, and a communication state between the cartridge-side communication unit and the apparatus-side communication unit varies depending on an amount of the developer in the developer container, wherein the developer cartridge further comprises:

a rotating shaft which rotates in the developer container; and a rocking member of which one end is attached to the rotating shaft slidably in a rotating direction of the rotating shaft, wherein the cartridge-side communication unit is attached to the other end of the rocking member, when the amount of the developer in the developer container exceeds a predetermined reference amount, the rocking member does not rock along rotation of the rotating shaft rotate due to intervention of developer and preferable communication state between the cartridge-side communication unit and the apparatus-side communication unit, and when the amount of the developer in the developer container is lower than the predetermined reference amount, the rocking member rocks to move the cartridge-side communicating unit along rotation of the rotating shaft and the communication state deteriorates due to movement of the cartridge-side communication unit.

14. A image forming apparatus comprising a developer cartridge equipped with a developer container, and an apparatus body, the image forming apparatus being used with the developer cartridge attached thereto to supply a developer in the developer container for development, wherein the developer cartridge comprises a cartridge-side communication unit which is provided inside the developer container and capable of communicating with the apparatus body, the apparatus body comprises an apparatus-side communication unit which is capable of communicate with the cartridge-side communication unit, and a communication state between the cartridge-side communication unit and the apparatus-side communication unit varies depending on an amount of the developer in the developer container, wherein the developer cartridge further comprises a communication unit holder which is attached inside the developer container while being open downward when the developer container is attached to the image forming apparatus, and holds the cartridge-side communication unit, when the amount of the developer in the developer container exceeds a predetermined reference amount, the cartridge-side communication unit is prevented from departing from the communication unit holder due to intervention of the developer and a preferable communication state with the apparatus-side communication unit is secured, and when the amount of the developer in the developer container is lower than the predetermined reference amount, the cartridge-side communication unit falls to depart from the communication unit holder and the communication state deteriorates.

15. A image forming apparatus comprising a developer cartridge equipped with a developer container, and an apparatus body, the image forming apparatus being used with the developer cartridge attached thereto to supply a developer in the developer container for development, wherein the developer cartridge comprises a cartridge-side communication unit which is provided inside the developer container and capable of communicating with the apparatus body, the apparatus body comprises an apparatus-side communication unit which is capable of communicate with the cartridge-side communication unit, a communication state between the cartridge-side communication unit and the apparatus-side communication unit varies depending on an amount of the developer in the developer container, and the cartridge-side communication unit is arranged at a location which corresponds to a bottom portion inside the developer container when the developer container is attached to the apparatus body with its communicable side facing the apparatus-side communication unit, the developer cartridge further comprises:

a blocking member which blocks communication between the cartridge-side communication unit and the apparatus-side communication unit; and a holder which holds the blocking member in front of the communicable side of the cartridge-side communication unit in a state which allows the blocking member to move up and down when the developer cartridge is attached to the apparatus body, wherein the developer in the developer container is non-magnetic, when the amount of the developer in the developer container exceeds a predetermined reference amount, the blocking member is supported by the developer at a location within a movable range provided inside the holder which does not allow the blocking member to block the communicable side of the cartridge-side communication unit and a preferable communication state between the cartridge-side communication unit and the apparatus-side communication unit is secured, and when the amount of the developer in the developer container is lower than the predetermined reference amount, the blocking member comes down from the location within the movable range provided inside the holder, which does not allow the blocking member to block the communicable side of the cartridge-side communication unit to eventually block the communicable side of the cartridge-side communication unit, and the communication state deteriorates.

16. A image forming apparatus comprising a developer cartridge equipped with a developer container, and an apparatus body, the image forming apparatus being used with the developer cartridge attached thereto to supply a developer in the developer container for development, wherein the developer cartridge comprises a cartridge-side communication unit which is provided inside the developer container and capable of communicating with the apparatus body, the apparatus body comprises an apparatus-side communication unit which is capable of communicate with the cartridge-side communication unit, and a communication state between the cartridge-side communication unit and the apparatus-side communication unit varies depending on an amount of the developer in the developer container, wherein the developer cartridge further comprises:

a holder which holds the cartridge-side communication unit at a location which corresponds to a bottom portion inside the developer container when the developer container is attached to the apparatus body with its communicable side facing the apparatus-side communication unit, the holder segregates the communicable side of the cartridge-side communication unit into an upper communication section and a lower communication section, and prevents the developer from entering around the lower communication section, the developer in the developer container is magnetic, when the amount of the developer in the developer container exceeds a predetermined reference amount, the upper communication section of the cartridge-side communication unit is covered with the developer and communication with the apparatus-side communication unit is carried out by only the lower communication section, and when the amount of the developer in the developer container is lower than the predetermined reference amount, the upper communication section appears out from the developer and the communication with the apparatus-side communication unit is carried out by the upper communication section.

17. A image forming apparatus comprising a developer cartridge equipped with a developer container, and an apparatus body, the image forming apparatus being used with the developer cartridge attached thereto to supply a developer in the developer container for development, wherein the developer cartridge comprises a cartridge-side communication unit which is provided inside the developer container and capable of communicating with the apparatus body, the apparatus body comprises an apparatus-side communication unit which is capable of communicate with the cartridge-side communication unit, and a communication state between the cartridge-side communication unit and the apparatus-side communication unit varies depending on an amount of the developer in the developer container, wherein the developer cartridge further comprises:

a weight which is located inside the developer container; and a flexible member which connects the weight and the cartridge-side communication unit, wherein the cartridge-side communication unit is attached to a location which corresponds to a ceiling face inside the developer container when the developer container is attached to the apparatus body, when the amount of the developer in the developer container exceeds a predetermined reference amount, the weight is supported by the developer and secures a preferable communication state of the cartridge-side communication unit without applying the weight's own weight to the cartridge-side communication unit, and when the amount of the developer in the developer container is lower than the predetermined reference amount, the weight removes the cartridge-side communication unit from an inner face of the developer container by applying the weight's own weight to the cartridge-side communication unit through the flexible member and the communication state deteriorates.

18. A image forming apparatus comprising a developer cartridge equipped with a developer container, and an apparatus body, the image forming apparatus being used with the developer cartridge attached thereto to supply a developer in the developer container for development, wherein the developer cartridge comprises a cartridge-side communication unit which is provided inside the developer container and capable of communicating with the apparatus body, the apparatus body comprises an apparatus-side communication unit which is capable of communicate with the cartridge-side communication unit, a communication state between the cartridge-side communication unit and the apparatus-side communication unit varies depending on an amount of the developer in the developer container, and the cartridge-side communication unit is attached to a location which corresponds to a ceiling face inside the developer container when the developer container is attached to the apparatus body, wherein the developer cartridge further comprises:

a string-like member which is connected to the cartridge-side communication unit; and a rotating shaft which rotates within the developer container and comprises protrusions which catch and wind up the string-like member entangled with the rotating shaft along rotation, when the amount of the developer in the developer container exceeds a predetermined reference amount, the protrusions are buried in the developer and secures a preferable communication state of the cartridge-side communication unit without catching and winding up the string-like member, and when the amount of the developer in the developer container is lower than the predetermined reference amount, the protrusions appear from the developer and remove the cartridge-side communication unit from an inner face of the developer container by catching and winding up the string-like member along rotation of the rotating shaft, and the communication state deteriorates.

* * * * *